US009167884B2

(12) United States Patent
Moreau et al.

(10) Patent No.: US 9,167,884 B2
(45) Date of Patent: Oct. 27, 2015

(54) ATTACHMENT SYSTEM FOR HAND-HELD TOOLS

(71) Applicant: Ty-Flot, Inc., Manchester, NH (US)

(72) Inventors: Darrell A. Moreau, Manchester, NH (US); Andre W. Moreau, Bedford, NH (US); Ben Bachman, Scranton, PA (US)

(73) Assignee: Ty-Flot, Inc., Manchester, NH (US)

( * ) Notice: Subject to any disclaimer, the term of this patent is extended or adjusted under 35 U.S.C. 154(b) by 0 days.

(21) Appl. No.: 14/681,211

(22) Filed: Apr. 8, 2015

(65) Prior Publication Data

US 2015/0208794 A1 Jul. 30, 2015

Related U.S. Application Data

(63) Continuation-in-part of application No. 14/047,124, filed on Oct. 7, 2013, now Pat. No. 9,038,873.

(51) Int. Cl.
*A45F 5/00* (2006.01)

(52) U.S. Cl.
CPC ..... *A45F 5/00* (2013.01); *A45F 2200/0575* (2013.01)

(58) Field of Classification Search
CPC ..... A45F 5/02; A45F 5/00; A45F 3/04; A45F 2005/026; A45F 2200/0575
USPC ..... 224/269–272, 904, 148.5, 148.6
See application file for complete search history.

(56) References Cited

U.S. PATENT DOCUMENTS

| | | | | |
|---|---|---|---|---|
| 4,200,249 | A * | 4/1980 | Synstelien et al. | 242/396.5 |
| 4,214,688 | A * | 7/1980 | Griffin, Jr. | 224/197 |
| 5,025,966 | A * | 6/1991 | Potter | 224/183 |
| 5,213,240 | A * | 5/1993 | Dietz et al. | 224/183 |
| 5,604,958 | A * | 2/1997 | Anscher | 24/3.1 |
| 6,041,444 | A * | 3/2000 | McKinney | 2/310 |
| 6,508,390 | B1 * | 1/2003 | Karpati | 224/270 |
| 6,651,855 | B1 * | 11/2003 | Flynn | 224/251 |
| 6,834,767 | B1 * | 12/2004 | Lin | 211/70.6 |
| 7,222,767 | B1 * | 5/2007 | Yang | 227/130 |
| 8,584,916 | B1 * | 11/2013 | Chen | 224/199 |
| 2002/0122707 | A1 * | 9/2002 | Sakai et al. | 408/241 R |
| 2003/0113680 | A1 * | 6/2003 | Genuise | 431/253 |
| 2005/0236545 | A1 * | 10/2005 | Seil et al. | 248/311.2 |
| 2010/0032465 | A1 * | 2/2010 | Moreau et al. | 224/660 |
| 2012/0141050 | A1 * | 6/2012 | Moreau et al. | 383/109 |

* cited by examiner

*Primary Examiner* — Brian D Nash
(74) *Attorney, Agent, or Firm* — Robert R. Deleault, Esq.; Mesmer & Deleault, PLLC

(57) ABSTRACT

An attachment system for tools includes a housing, a rotating member having a sloping surface and a catch surface disposed in an open central region of the housing, and a clip member having a clip protrusion with a head and neck portions where the neck portion is sized to be slidably receive in one of a first and second slot of the housing where each slot extends through a wall of the housing to the open central region. The clip protrusion engages the sloping surface causing the rotating member to rotate about a central longitudinal axis to a point as the neck portion moves distally along one of the slots where a catch surface aligns with the clip protrusion and where a channel aligns with a clip protrusion of a second clip member retained in the second slot, thereby retaining the first clip member and releasing the second clip member.

19 Claims, 16 Drawing Sheets

ATTACHMENT SYSTEM FOR HAND-HELD TOOLS

This application is a Continuation-in-Part application of Ser. No. 14/047,124, filed on Oct. 7, 2013.

BACKGROUND OF THE INVENTION

1. Field of the Invention

The present invention relates generally to tool accessories and more particularly to an attachment system for hand-held tools.

2. Description of the Prior Art

Lanyards, tethers, hooks, and similar restraints are used to prevent accidental dropping of tools. These restraints are particularly useful in environments where a tool drop can cause substantial damage or harm to plant equipment, workers, or objects below a worker who accidentally drops a tool.

One method of restraining tools is to clip one end of a tether to an opening in the handle of a tool (e.g., an adjustable wrench) and to clip the other end of the tether to the worker's belt or to a nearby structure. When workers properly tether a tool in this way, accidental drops can be eliminated or greatly reduced. However, if a worker uses many tools to complete a task, then the worker implementing this method must tether each tool. The worker may switch a single tether between multiple tools or provide one tether for each tool. In some cases, switching the tether to a different tool is the cause of an accidental drop.

One approach to tethering tools is described in PCT published patent application number WO 2012/054979 for TOOL ATTACHMENT SYSTEM. The tool attachment system is adapted for use with at least two retainers. The device has two slot-like mountings that are open at one end to receive a retainer. A latch mechanism is movable between first and second positions for each mounting. The latch mechanism pivots about a transverse pivot axis positioned between a head portion and a tail portion. A portion of the latch mechanism extends into the mounting slot so that a retainer bears on the latch as the retainer is passed into the slot. A first retainer engaged with the device causes the latch mechanism to pivot to a first position, where the first retainer cannot be detached from the device until another retainer has been engaged with the device and causes the latch mechanism to move to a second position.

SUMMARY OF THE INVENTION

An alternative approach to the system described above is needed. When a worker uses many tools to complete a task, tethering each tool becomes a safety hazard in itself. When each tool is separately tethered, the worker's job is made more difficult and frustrating when tethers become tangled. Also, the worker's safety is compromised by having a plurality of tethers in the work area because the likelihood increases that the worker will become tangled in or tripped by tethers.

Therefore, what is needed is an attachment system for hand-held tools that solves the problems described above.

It is an object of the present invention to permit workers to quickly switch between tethered tools.

It is another object of the present invention to permit a tethered tool to be selectively tethered to the worker.

It is another object of the present invention to provide an attachment system that reduces and/or prevents accidental drops of hand-held tools.

It is another object of the present invention to reduce entanglement of tethers used with multiple hand-held tools.

The present invention achieves these and other objectives by providing an attachment system for hand-held tools, where the system includes a housing with a wall defining an open central region. The housing has a first slot and a second slot extending through the wall to the open central region. A rotating member is disposed in the open central region, has a sloping surface and a catch surface extending transversely from the rotating member, and is adapted to rotate about the central longitudinal axis of the rotating member between a first position and a second position. A clip member has a clip body with a housing-side surface and a clip protrusion extending from the housing-side surface. The clip protrusion is adapted to be slidably received in and retained by one of the first and the second slots. The clip protrusion engages the sloping surface of the rotating member to rotate the rotating member to either a first position or a second position that causes the clip protrusion to either be retained by the catch surface in the housing or released from the catch surface in the housing.

In one embodiment, the attachment system has a housing with a proximal housing end portion, a distal housing end portion, and a peripheral wall defining an open central region within the housing. The peripheral wall has a first slot and a second slot each with a predefined slot width and extending through the peripheral wall to the open central region. The first slot and the second slot each has a proximal slot end and a distal slot end, where the proximal slot end has a proximal slot end width that is greater than the predefined slot width. The enlarged proximal slot facilitates placing the clip protrusion in the first or second slot when engaging a clip member with the housing.

In another embodiment, the attachment system includes a biasing member disposed between the housing and the rotating member. In one embodiment, the biasing member is configured to rotationally bias the rotating member towards an intermediate/neutral position between the first position and the second position. When in the intermediate position, the catch surface of the first body portion is positioned to engage the tip portion of the clip member to retain the clip member within the housing. In another embodiment, the biasing member is configured to bias the rotating member distally or proximally along the central longitudinal axis, thereby establishing frictional engagement between the rotating member and the housing to prevent free rotation of the rotating member in response to vibration or gravitational forces.

In one embodiment, the biasing member is a spring connected between the rotating member and the housing.

In one embodiment, a rotating member includes a member body rotatably connected to the housing and having a peripheral surface extending along the central longitudinal axis. A first body portion extends radially outward a predefined distance from the peripheral surface, the first body portion defining a catch surface facing distally. The catch surface extends along a radial portion of the peripheral surface between a first body end and a second body end and defines a first body channel between the first body end and the second body end of the first body portion.

A second body portion extends radially outward from the peripheral surface and is positioned distally of the first body portion. The second body portion defines a first sloping surface and a second sloping surface forming an apex positioned facing the first body channel at substantially a midpoint between the first body end and the second body end of the first body portion. The first sloping surface and the second sloping surface each face proximally and extend distally in opposite peripheral directions along the peripheral surface from the apex. In one embodiment, the first and second sloping surfaces each spiral from the apex distally in opposite directions about 180 degrees around the peripheral surface towards a point of intersection on the opposite side of the rotating member.

In one embodiment, a clip protrusion has a neck portion, a head portion and a tip portion. The neck portion is sized to be slidably received in the first slot and/or the second slot. The head portion is sized to engage an inside surface of the wall of the housing adjacent the slot to retain the clip protrusion within the first and/or second slot. The tip portion is sized and configured to engage the first sloping surface or the second sloping surface and rotate the rotating member about the central longitudinal axis as the neck portion moves along the first slot or the second slot from the proximal slot end.

When the tip portion of a first clip member moves distally in the first slot in engagement with the first sloping surface, the tip portion causes the rotating member to rotate in a first direction about the central longitudinal axis, thereby causing the catch surface to align with the tip portion and causing the first member channel to align with a tip portion of a second clip member retained by the housing within the second slot. When the first channel member moves into alignment with the tip portion of the second clip member, the second clip member is released from the catch surface and is removable from the second slot.

Similarly, when the tip portion of a second clip member moves distally in the second slot in engagement with the second sloping surface, the tip portion causes the rotating member to rotate in a second direction opposite the first direction about the central longitudinal axis, thereby causing the catch surface to align with the tip portion of the second clip and causing the first member channel to align with a tip portion of the first clip member retained within the first slot. When the first channel member moves into alignment with the tip portion of the first clip member, the first clip member is released from the catch surface and is removable from the first slot.

In still another embodiment, a biasing washer is disposed between the biasing member and the rotating member. The biasing washer has a radially extending rib on a lower surface of the washer where the radially extending rib selectively engages a radially extending rib channel disposed on a shoulder of the rotating member. The radially extending rib also has a radial length with an outside rib end that engages a recess formed on the inside surface of the housing in order to prevent the washer from rotating when the rotating member rotates. The engagement of the extending rib with the rib channel temporarily holds the rotating member in position until the rotating member is engaged by the clip protrusion causing the rotating member to again rotate.

In another embodiment, the rotating member is biased to return to the intermediate position after the tip portion moves distally past the catch surface.

In another embodiment, the clip protrusion includes a head portion between the tip portion and the neck portion. The head portion has a cross-sectional area that is greater than a cross-sectional area of the neck portion. In one embodiment, the head portion is sized and configured to engage an inside surface of the housing when the neck portion extends through the first slot or the second slot.

In another embodiment, the rotating member is maintained at the first position or the second position until a clip member engages the rotating member to rotate the rotating member to the other of the first position or the second position.

In one embodiment, the peripheral wall is substantially cylindrical.

In another embodiment, the attachment system includes a cap installed on the housing distal end portion, where the cap has a recess sized and configured to receive a distal end of the rotating member. In one embodiment, the cap defines an opening configured to permit access to the distal end of the rotating member. In one embodiment, the distal end of the rotating member is configured for engagement with a tool for rotating the rotating member.

In still another embodiment, the rotating member has a member body rotatably connected to the housing. The rotating member has a distal end portion connected to one end of the member body and a proximal end portion connected to an opposite end of the member body. Extending transversely from the member body is a first member wing and a second member wing on opposite sides of the member body from a middle portion. Each wing has a curved, front sloping surface, a catch surface and a back surface. The wings define a first body channel between the front sloping surface of the first member wing and the second member wing and a second body channel between the back surface of the first member wing and the second member wing. The front sloping surface of each wing is aligned with one of the first slot and the second slot of the housing such that the sloping surface is presented for interaction with a clip protrusion of the clip member to rotate the rotating member between an intermediate/neutral position to one of a first position or a second position depending on the slot used.

The present invention also includes a method of tethering a hand tool. In one embodiment, the method includes tethering a tool to a housing assembly having a housing and a rotating member as described above. The user engages a first clip member with the housing assembly, where the clip member has a clip body, a housing-side surface, and a clip protrusion as described above. The user moves the clip member distally along the first slot with the clip protrusion in engagement with the first sloping surface to cause the rotating member to rotate in a first direction about the central longitudinal axis to a point that then causes the catch surface to align with the clip protrusion. This movement retains the first clip member in engagement with the housing assembly.

In the first embodiment of the rotating member, moving the tip portion distally also causes the first member channel to align with a tip portion of a second clip member retained by the housing along the second slot. In another embodiment, the method also includes engaging a second clip member with the housing assembly, where the second clip member having a second tip portion substantially identical to the tip portion of the first clip member. The user moves the second clip member distally along the second slot with the second tip member in engagement with the second sloping surface. This movement causes the rotating member to rotate in a second direction about the central longitudinal axis, causes the catch surface to align with the tip portion of the second clip member, and causes the first member channel to align with the tip portion of the first clip member retained in engagement with the housing assembly. With the first member channel aligned with the tip portion of the first clip member, the user moves the first clip member proximally in the first slot to release the first clip member from engagement with the housing assembly. The user then removes the first clip member from the housing assembly.

In the second embodiment of the rotating member, moving the clip protrusion distally causes the rotating member to rotate to a first position allowing the clip protrusion to pass through the first channel between the first and second wings where the rotating member automatically returns to the intermediate/neutral position causing the catch surface of the first wing to align with the clip protrusion to retain the clip member within the housing. Simultaneously with the above-described action, the movement of the clip protrusion along the first slot also causes the second member channel between the rear sides of the first and second wings to align with a clip protrusion of a second clip member retained by the housing along the second slot thereby allowing the clip protrusion of the second clip member to pass through the second channel and releasing the second clip member from the housing. In another embodiment, the method also includes engaging a second clip member with the housing assembly where the second clip member has a clip protrusion substantially identical to the clip protrusion of the first clip member. The user moves the second clip member distally along the second slot with the clip protrusion in engagement with the second sloping surface of the second wing. This movement causes the rotating member to rotate in a second direction about the central longitudinal axis against the force of a biasing member to a point where the clip protrusion is distally beyond the second wing. The biasing force of the biasing member forces the rotating member to return to the intermediate/neutral position and causes the catch surface to align with the clip protrusion of the second clip member. Simultaneously as the rotating member is rotated by the second clip member, the rotating action causes the second member channel to align with the clip protrusion of the first clip member previously retained in engagement with the housing assembly. With the second member channel aligned with the clip protrusion of the first clip member, the first clip member is released from the catch surface of the first wing thereby releasing the first clip member from engagement with the housing assembly.

In one embodiment of the method, the first clip member is attached to a user's wrist and the second clip member is attached to a user's tool belt, tool box, wall fixture, or other structure.

The present invention also includes a method of making an attachment system for hand tools. In one embodiment, the method includes forming a housing as described above with a proximal housing end portion, a distal housing end portion, and a peripheral wall defining an open central region within the housing. The peripheral wall has a first slot and a second slot each with a predefined slot width and extending through the peripheral wall to the open central region. The first slot and the second slot each has a proximal slot end and a distal slot end, where the proximal slot end has a proximal slot end width that is greater than the predefined slot width. A rotating member is disposed in the open central region and configured to rotate about the central longitudinal axis between a first position and a second position. The rotating member has a member body, a sloping surface, and catch surface as described above. One or more clip members are formed. The clip member(s) have a clip body with a housing-side surface and a clip protrusion as described above.

In one embodiment, the peripheral wall is substantially cylindrical. In other embodiments, a biasing member is disposed between the housing and the rotating member. In one embodiment, the biasing member is configured to rotationally bias the rotating member towards an intermediate position between the first position and the second position. In another embodiment, the biasing member is configured to bias the rotating member along the central longitudinal axis to establish frictional engagement between the rotating member and the housing to prevent unrestricted rotation of the rotatable member.

One may use the attachment system of the present invention to tether one or more tools. A tool is connected by a tether, lanyard, or the like to the housing assembly. The user attaches a first clip member to a first location, such as to the user's wrist. The user attaches a second clip member to a second location, such as to the user's tool belt or other wrist. The user then engages the first clip member with the housing assembly to tether the tool to his wrist. The user then may engage the second clip member with the housing assembly to tether the tool to the tool belt or other wrist. By engaging the second clip member, the first clip member is released from the housing assembly. Using the attachment system, the user may switch between multiple tethered tools without becoming tangled in tethers. The user may also change the point of attachment for a single tethered tool, such as from a wrist to a tool belt, tool box, wall fixture, or other structure. Many other uses and configurations are contemplated with the attachment system of the present invention.

DETAILED DESCRIPTION OF THE PREFERRED EMBODIMENT

Figure 1:
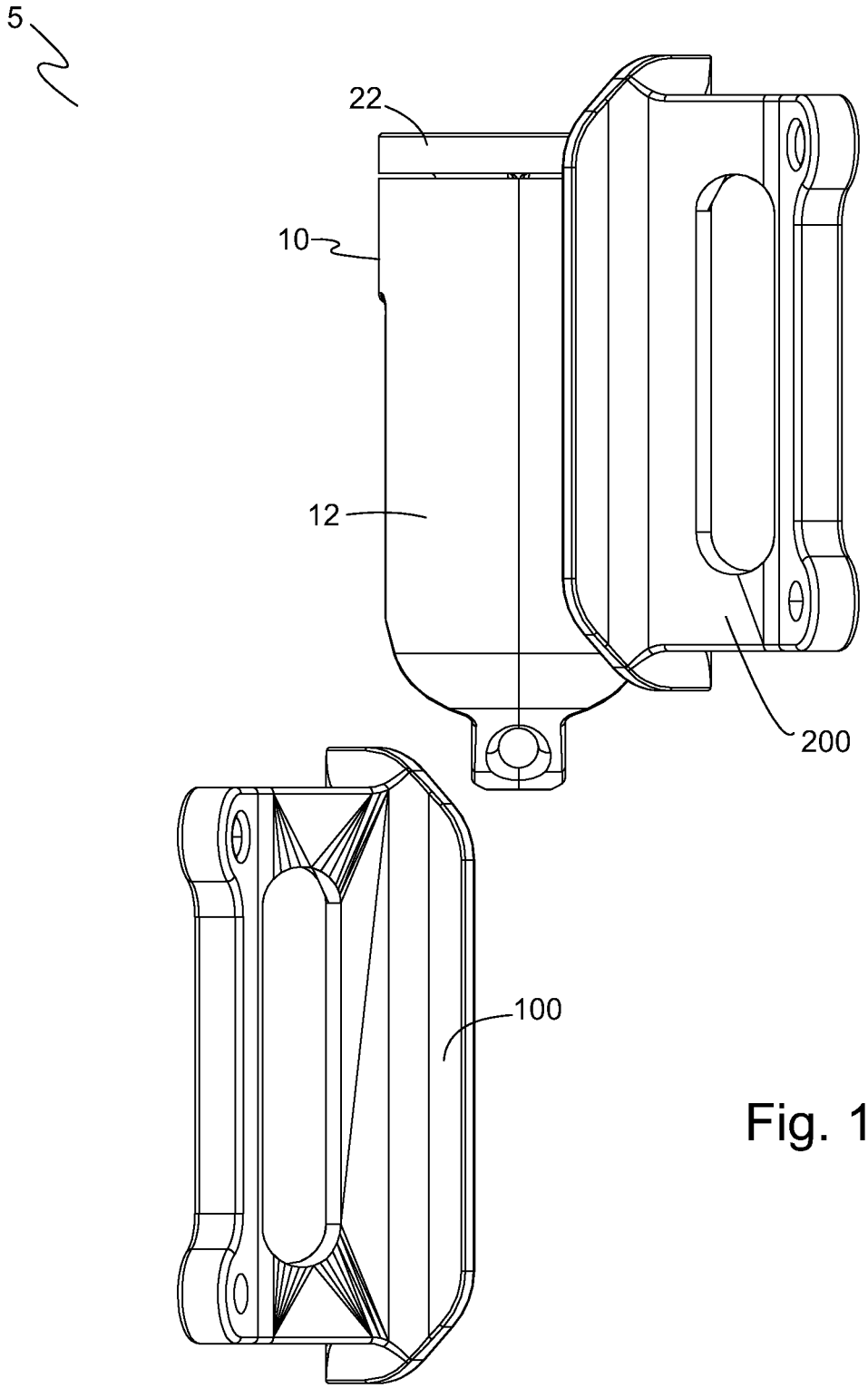
FIG. 1 is an elevation of one embodiment of an attachment system of the present invention showing a housing assembly and two clip members.

The preferred embodiments of the present invention are illustrated in FIGS. 1-21. FIG. 1 illustrates one embodiment of an attachment system 5 that includes a housing assembly 10, a first clip member 100 separated from housing assembly 10, and a second clip member 200 engaged with housing assembly 10. Housing assembly 10 includes a housing 12, an optional cap 22, and a rotating member 300 (not visible) disposed in an open central region 14 (not visible) within housing 12 as is discussed below in more detail with reference to FIGS. 3-5.

Figure 2:
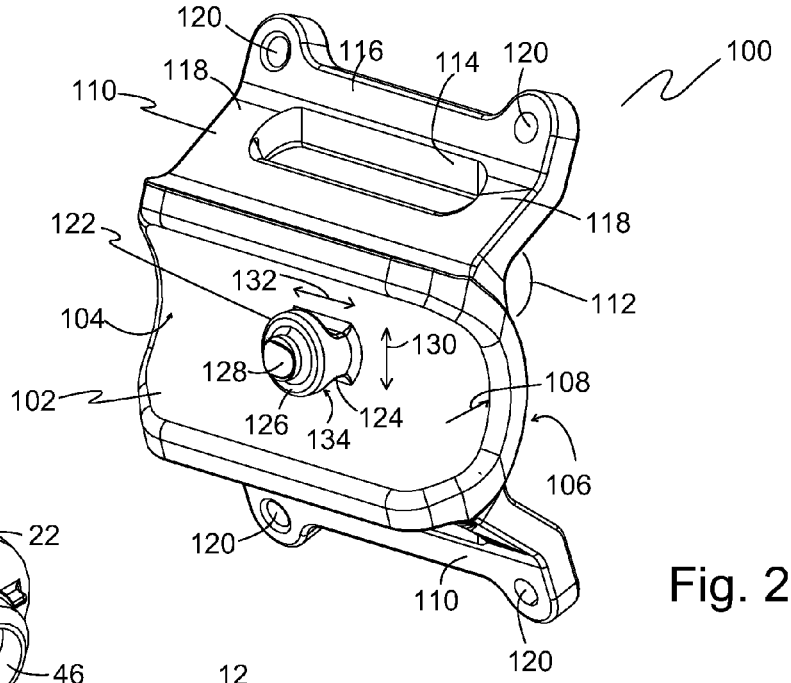
FIG. 2 is a perspective view of one embodiment of a clip member of the present invention showing a housing-side surface with a clip protrusion.
Figure 10:
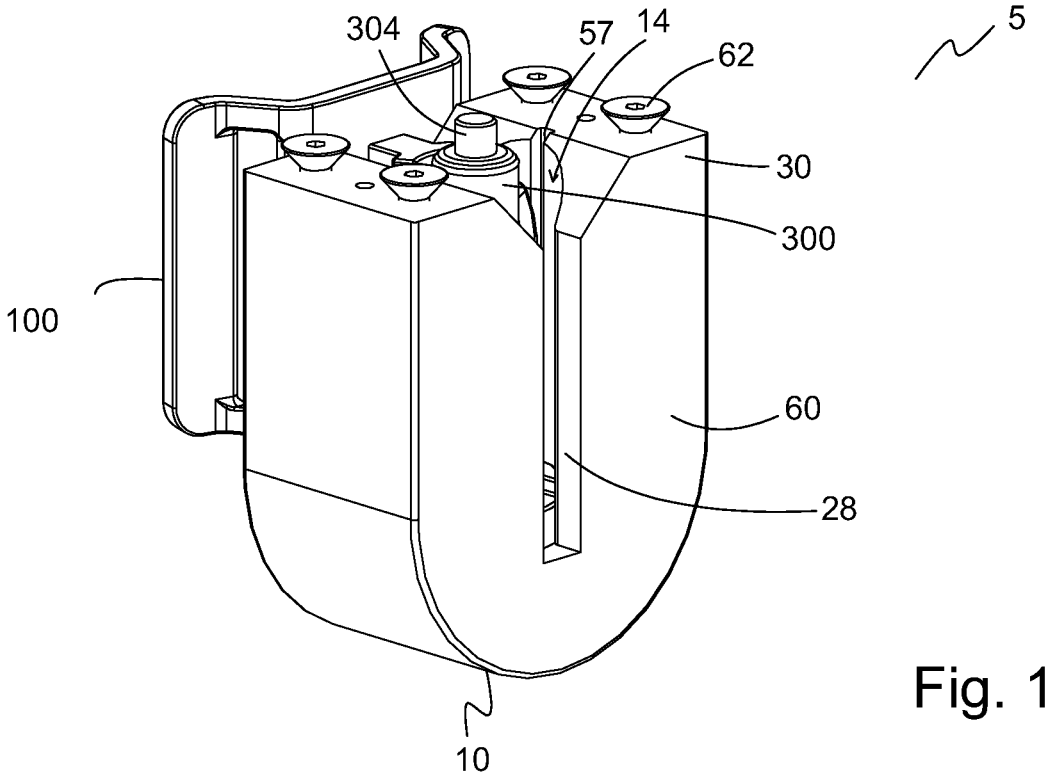
FIG. 10 is a perspective view of another embodiment of an attachment system of the present invention.

FIG. 2 illustrates a perspective view of first clip member 100 as shown in FIG. 1. First clip member 100 and second clip member 200 are preferably identical and interchangeable, so the features described here for first clip member 100 also apply to embodiments of second clip member 200. First clip member 100 has a clip body 102 with a housing-side surface 104 and an outside surface 106. In one embodiment, housing-side surface 104 is shaped to mate with outside surface 16 of a perimeter wall 18 of housing 12 (discussed below). Preferably, outer surface 16 of perimeter wall 18 is substantially cylindrical. Accordingly, housing-side surface 104 of first clip member 100 is curved with a consistent radius of curvature 108. Other geometries for housing-side surface 104 and body portion 102 are also acceptable, such as planar and curved with varying radii of curvature 108. One such alternate geometry is shown in FIG. 10, which is discussed below.

In one embodiment, two handles 110 extend from clip body 102, preferably at an internal angle 112 with outside surface 106 that is greater than ninety degrees. Each handle 110 defines a handle opening 114 between outside surface 106 and a longitudinal portion 116 that extends between two end portions 118 of handle 110. End portions 118 are preferably disposed at opposite ends of clip body 102. Handles 110 are useful for maneuvering first clip member 100 to engage housing assembly 10 and for attachment of clip member 100 to the user by way of a belt or webbing passing through handles 110. In another embodiment, each handle 110 of first clip member 100 has one or more through opening 120 useful, for example, for mounting clip member 100 to a wall, tool box, or other structure using screws or other fastener.

A clip protrusion 122 extends from housing-side surface 104 and has a neck portion 124, a head portion 126, and a tip portion 128. Neck portion 124 is sized and configured to extend through first slot 26 or second slot 28 of perimeter wall 18 (shown in FIG. 3) so that head portion 126 and tip portion 128 are disposed in open central region 14 defined within housing 12. Housing 12 is discussed below in more detail below.

In one embodiment, neck portion 124 has a cross-sectional shape of a rectangle, oval, circle, or other shape. Clip protrusion 122 increases in width 130 from neck portion 124 to head portion 126. In one embodiment, head portion 126 has substantially the same length 132 as neck portion 124. The increased size of head portion 126 relative to neck portion 124 provides a protrusion catch surface 134 that faces housing-side surface 104 of body portion 102. Protrusion catch surface 134 is shaped and configured to engage an inside surface 38 (shown in FIG. 3) of perimeter wall 18 adjacent first slot 26 or second slot 28. In this way, clip protrusion 122 guides first clip member 100 in sliding movement along first slot 26 or second slot 28 while also retaining first clip member 100 close to or against outside surface 16 of perimeter wall 18.

Figure 3:
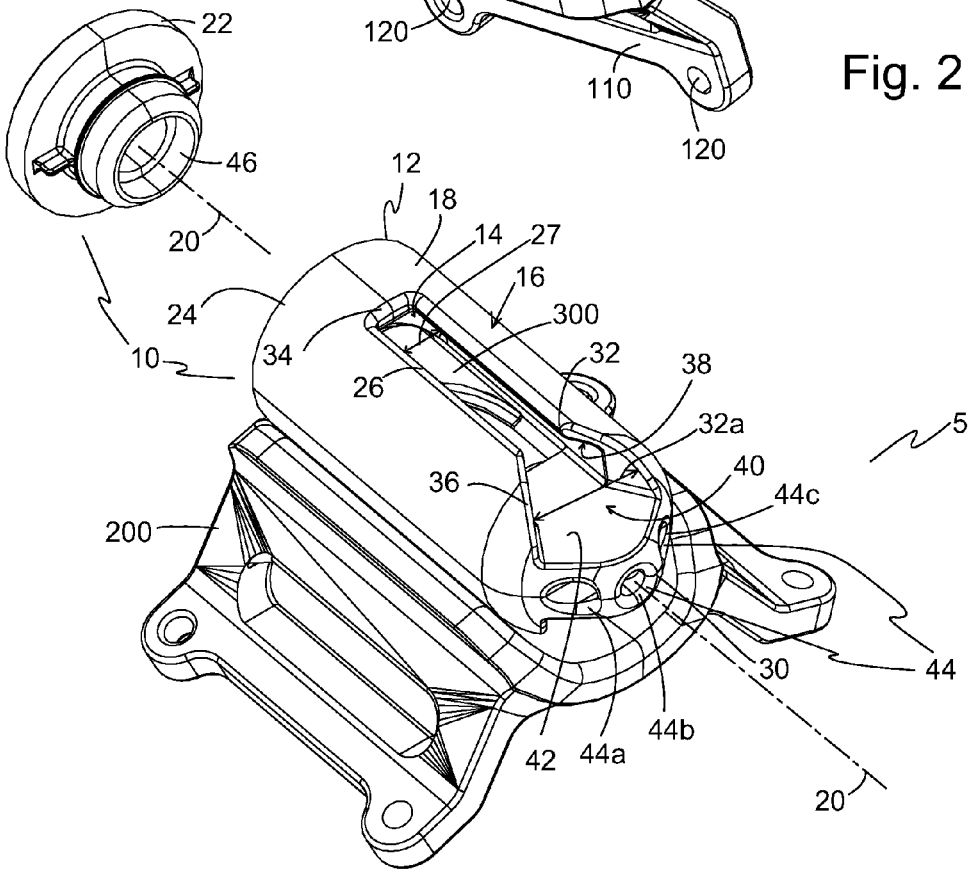
FIG. 3 is a partially-exploded, perspective view of part of the system of FIG. 1 showing a cap separated from the housing distal end and showing one clip member retained by the housing assembly.

FIG. 3 illustrates a perspective view of housing assembly 10 and second clip member 200 of attachment system 5 shown in FIG. 1. Second clip member 200 is retained by housing assembly 10. In one embodiment, perimeter wall 18 of housing 12 has a substantially cylindrical shape extending along a central longitudinal axis 20. Other geometries are acceptable. Housing 12 has a proximal housing end portion 30 and a distal housing end portion 24. In one embodiment, housing 12 includes a cap 22 installed on distal housing end portion 24. Cap 22 is useful to close distal end 24 as well as to provide a seat or recess 46 (also shown in FIG. 5) for rotating member 300. Cap 22 may be installed, for example, by threaded engagement with perimeter wall 18 (either internally or externally); by using an adhesive, welding, fasteners, or clips; or by a friction fit (a.k.a. a press fit or interference fit) with distal housing end portion 24 of perimeter wall 18. In other embodiments, housing 12 omits cap 22 and instead has a closed or partially-closed distal housing end portion 24 integrally formed as part of housing 12.

In one embodiment, proximal housing end portion 30 is rounded or tapers towards a point along central longitudinal axis 20. In such an embodiment, proximal housing end portion 30 may optionally include at least one opening 44 for attachment of a lanyard or tether. In one embodiment, proximal housing end portion 30 has three openings 44 disposed in a line with a center opening 44*b* centered on and extending distally through perimeter wall 18 along central longitudinal axis 20. Side openings 44*a*, 44*c* are defined, for example, by a bore perpendicular to central longitudinal axis 20 and extending through proximal housing end portion 30. Openings 44 are useful for connecting attachment system 5 to a hand-held tool with a length of rope, a connector, lanyard, or the like passing through openings 44.

Perimeter wall 18 defines a first slot 26 and a second slot 28 (not shown) opposite first slot 26, where each slot 26, 28 communicates with and permits access to open central region 14. First slot 26 and second slot 28 (not visible) oppose each other and are preferably disposed 180° from one another on opposite sides of housing 12. First slot 26 and second slot 28 have a predefined width 27 and extend along (preferably parallel to) central longitudinal axis 20 from a proximal slot end 32 to a distal slot end 34. In one embodiment, first slot 26 and second slot 28 each have an open proximal slot end 32 and a closed distal slot end 34. In one embodiment, proximal slot end 32 has proximal sides 36 that extend outward at an angle with respect to central longitudinal axis 20 to provide an entrance 40 with a width 32*a* that is greater than predefined width 27 of first slot 26 or second slot 28. In this way, clip protrusion 122 on clip member 100 may enter first slot 26 and be guided by proximal sides 36 into slot 26 by moving clip member 100 along housing 12 in a direction substantially parallel to central longitudinal axis 20.

In another embodiment, entrance 40 to first slot 26 and second slot 28 is an opening through perimeter wall 18 with a size that is greater than predefined width 27. For example, if housing 12 is a cylinder, proximal slot end 32 is an opening through perimeter wall 18 with a width 32*a* (or diameter) that is greater than predefined width 27 of first slot 26 and sized to receive head portion 126 of clip protrusion 122. In this way, clip protrusion 122 may enter first slot 26 by moving towards housing 12 in a direction substantially perpendicular to central longitudinal axis. Then, after clip protrusion 122 enters proximal slot end 32, clip member 100 is moved along first slot 26 guided by protrusion 22 engaging perimeter wall 18.

In one embodiment, a first guide plate 42 extends distally into open central region 14 from proximal housing end portion 30 and substantially parallel to first slot 26. First guide plate 42 separates first slot 26 from open central region 14 and proximal end 304 of rotating member 300. First guide plate 42 provides a surface that is offset from perimeter wall 18 to facilitate entry of protrusion 122 on first clip member 100 into first slot 26 without engaging rotating member 300 when protrusion 122 is positioned at entrance 40. First guide plate 42 is positioned so that neck portion 124 of protrusion 122 aligns with and extends through first slot 26, that body portion 126 is positioned close to or against inside surface 38 along first slot 26, and that tip portion 128 is positioned to either engage or be substantially close to rotating member 300 as first clip member 100 moves distally or proximally along first slot 26. Tip portion 128 extends toward rotating member 300 sufficient to engage a catch surface 313 (shown in FIG. 5). Similar to first guide plate 42, a second guide plate 43 extends distally into open central region 14 from proximal housing end portion 30.

Figure 4A:
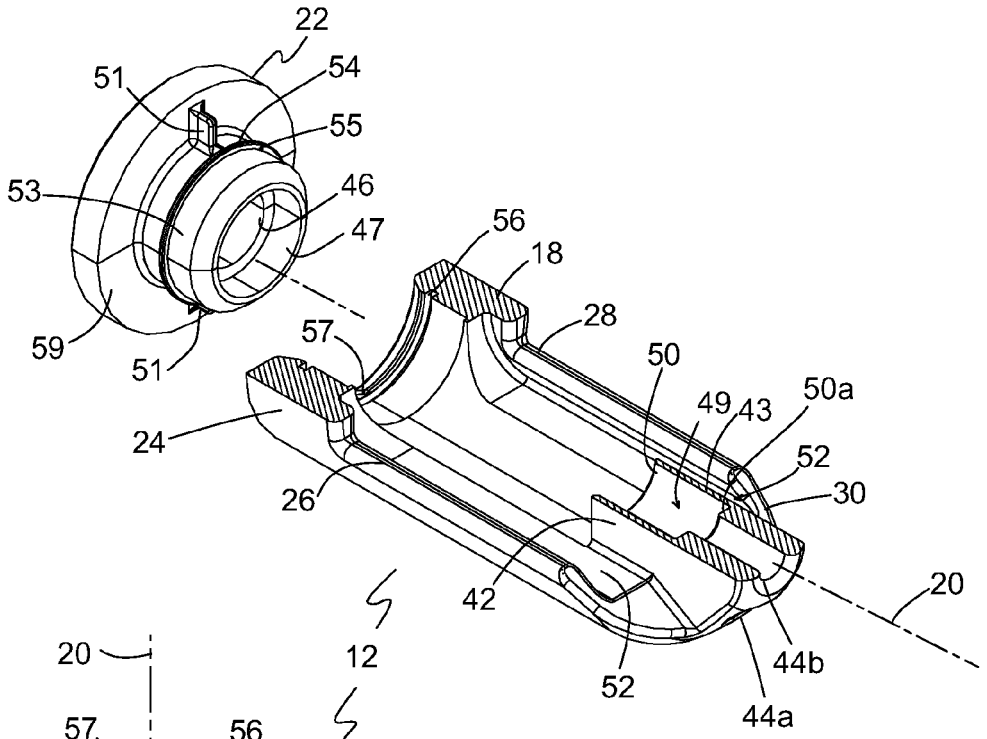
FIG. 4A is a perspective view of a cap and section of a housing of the system of FIG. 1.
Figure 4B:
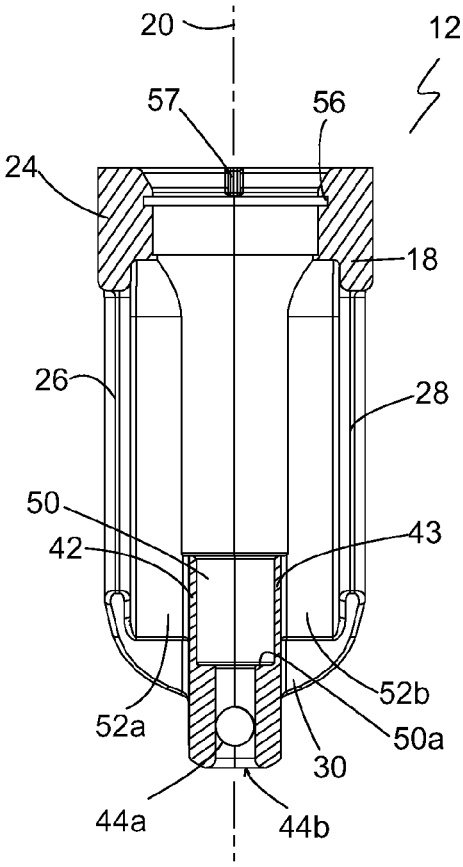
FIG. 4B is cross-sectional side view of the housing of FIG. 4A shown without the cap.

Referring now to FIGS. 4A and 4B, a section of housing 12 is illustrated in perspective and elevation views, respectively. Housing 12 is shown as a section along central longitudinal axis 20 and through first slot 26 and second slot 28. In one embodiment as shown in FIG. 4A, cap 22 has a cap body 53 and a cap plate 59. Cap body 53 is configured to be disposed in distal housing end portion 24 and retained there with a washer 54 (e.g., split washer) that is seated in a circumferential cap slot 55 extending around cap body 53. Washer 54 is compressed into cap slot 55 to allow cap body 53 to be inserted into distal housing end portion 24. Upon insertion, washer 54 expands to its uncompressed state to occupy a slot 56 in perimeter wall 18, thereby retaining cap 22 on housing 12. In this embodiment, cap 22 with washer 54 creates a snap-fit with perimeter wall 18, where cap 22 is pressed into place with cap body 53 received in distal housing end portion 24 and cap plate 59 abutting distal housing end portion 24.

Figure 5:
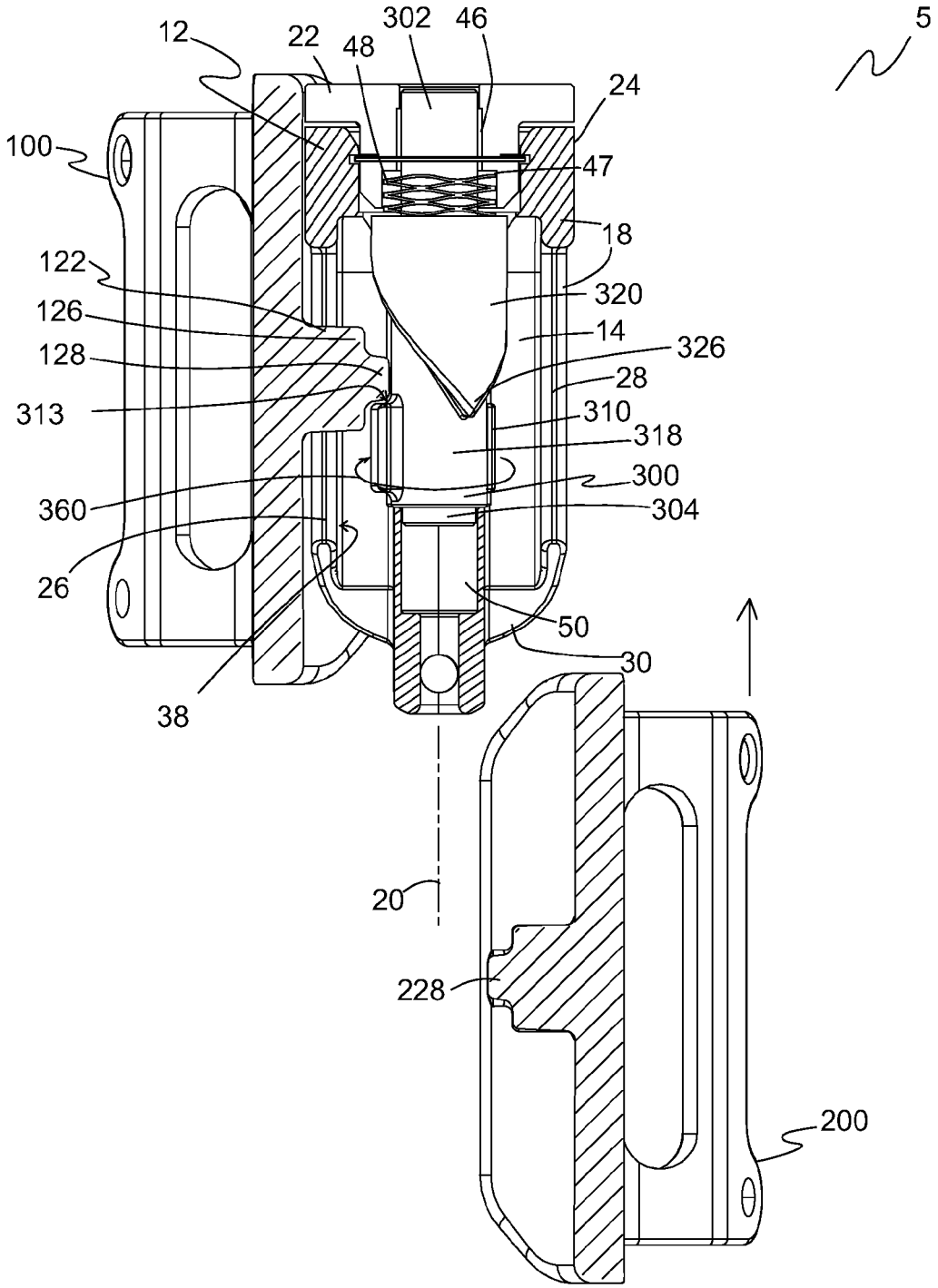
FIG. 5 is a partial cross-sectional view of the system of FIG. 1 showing a rotating member disposed in the housing, a portion of a first clip member with its clip protrusion retained in a first slot of the housing assembly and a portion of a second clip member with its clip protrusion positioned to move distally along a second slot of the housing assembly.

Cap 22 has a first distal recess 46 sized to receive distal end 302 of rotating member 300 (see also FIG. 5). In one embodiment, first distal recess 46 includes an opening (not visible) extending axially through cap plate 59. In such an embodiment, rotating member 300 is retained in position by second body portion 320 abutting cap body 53 or other portions of housing 12 or cap 22. In one embodiment, cap 22 also has a second distal recess 47 sized to receive an optional biasing member 48, which is discussed below with reference to FIG. 5. In one embodiment, cap 22 has at least one optional centering tab 51 that protrudes radially from cap body 53 and/or axially from cap body 59. Centering tab 51 fits into a corresponding tab recess 57 in housing 12 to prevent rotation of cap 22 with respect to distal housing end portion 24.

Housing 12 defines a proximal recess 50 in proximal housing end portion 30. Proximal recess 50 is sized to receive a proximal end 304 of rotating member 300 (shown in FIG. 5). In one embodiment, proximal recess 50 is defined at least partially by first guide plate 42 and second guide plate 43 and/or is positioned between first guide plate 42 and second guide plate 43. Proximal recess 50 preferably has a cylindrical inside surface 49 to receive a cylindrical rotating member 300. Proximal recess 50 defines a gap or airspace to accommodate a lanyard knot or swage fitting that is retained in proximal recess 50 by abutment with a shoulder or ledge 50*a* between proximal recess 50 and opening 44*b*, which has a smaller cross-sectional area than proximal recess 50.

A channel 52 is defined between perimeter wall 18 and each of first guide plate 42 and second guide plate 43. For example, channel 52*a* accepts tip portion 128 and head portion 126 of clip protrusion 122 as first clip member 100 enters first slot 26. First guide plate 42 protects rotating member 300 from contacting clip protrusion 122 until clip protrusion 122 is slidably engaged in first slot 26 and has moved distally beyond first guide plate 42, thereby preventing any further transverse movement with clip protrusion 122 towards rotating member 300 by a user. Similarly, channel 52*b* accepts tip portion 228 and head portion 226 of clip protrusion 222 as second clip member 200 enters second slot 28. Second guide plate 43 protects rotating member 300 from contacting clip protrusion 222 until clip protrusion 222 is slidably engaged in second slot 28 and has moved distally beyond second guide plate 43.

Center opening 44*b* extends axially into proximal end portion 30 of housing 12 along central longitudinal axis 20. Side openings 44*a*, 44*c* (only opening 44*a* is visible) extends through proximal end portion 30 transversely to central longitudinal axis 20. Side opening 44*a* and side opening 44*c* communicate with center opening 44*b*.

Referring now to FIG. 5, an embodiment of attachment system 5 is illustrated in a partial sectional elevation with rotating member 300 and sections of first clip member 100, second clip member 200, and housing 12. Rotating member 300 is disposed in open central region 14 and retained between proximal housing end portion 30 and distal housing end portion 24. Rotating member 300 is configured to rotate about central longitudinal axis 20 between a first position and a second position with distal end portion 302 received by first distal recess 46 and proximal end portion 304 received in proximal recess 50.

Optional biasing member 48 is disposed in second distal recess 47 between rotating member 300 and cap 22. In one embodiment, biasing member 48 is a compression spring, coil spring, or other spring device that biases rotating member 300 towards proximal housing end portion 30 to provide frictional engagement with housing 12, thereby preventing rotating member 300 from freely rotating due to gravity, movement of housing 12, or vibration. In such an embodiment, biasing member 48 generally prevents rotating member 300 from freely rotating except, for example, by sliding engagement of protrusion 122 on clip member 100 with second body member 320 of rotating member 300, or by turning rotating member 300 manually or with a tool.

In another embodiment, biasing member 48 is a coil spring that is coiled around rotating member 300 with one end connected, for example, to distal end portion 302 and the other end connected to housing 12 (or to cap 22). In this embodiment, a rotating member 300 is rotated about central longitudinal axis 20 in either direction from a predefined intermediate position, the spring force of biasing member 48 urges rotating member 300 to return to the intermediate position. In such an embodiment, when rotating member 300 is in its intermediate position, first body member 310 is positioned to retain both first clip member 100 and second clip member 200 due to first body member 310 being aligned with both of tip portion 128 and tip portion 228 of first clip member 100 and second clip member 200, respectively. Thus, moving either first clip member 100 or second clip member 200 distally would rotate rotating member 300 to release the other clip member from housing assembly 10.

As shown in FIG. 5, first clip member 100 is retained by housing assembly 10 due to tip portion 128 abutting a catch surface 313 on first body portion 310 of rotating member 300 and due to head portion 126 engaging inside surface 38 of perimeter wall 18. Rotating member 300 has been rotated to its first position due to first clip member 100 engaging rotating member 300 as first clip member 100 is moved along first slot 26. In its first position, catch surface 313 is positioned to engage tip portion 128 and prevent first clip member 100 from exiting housing 12. A channel 318 defined by first body member 310 permits second clip member 200 to exit housing 12 by moving proximally along second slot 28. Second clip member 200 is positioned to enter second slot 28. When it does so, tip portion 228 will engage second protrusion 320 and cause rotating member 300 to rotate in a second direction indicated by arrow 360. Channel 318 is discussed in more detail below.

Figure 6:
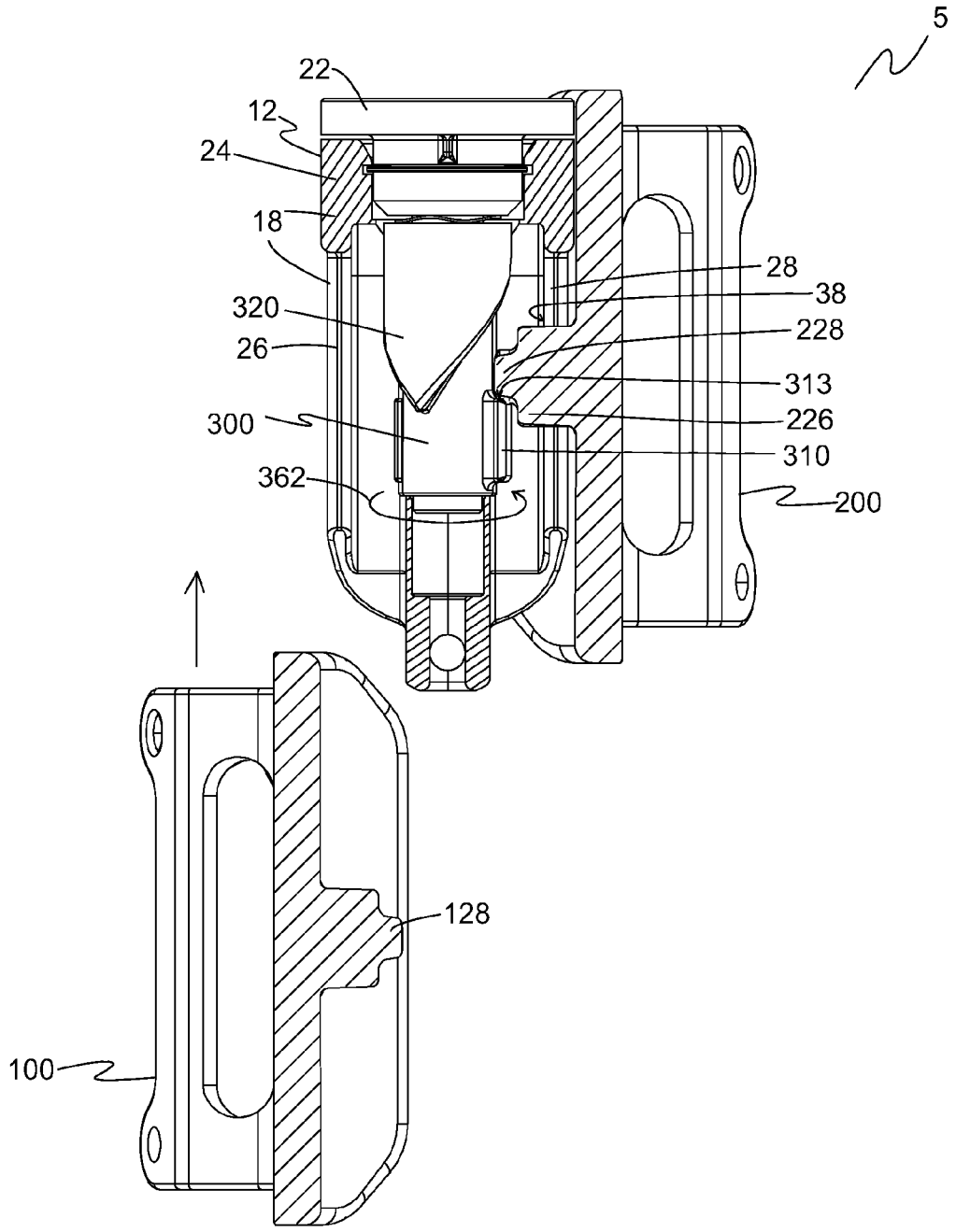
FIG. 6 is a partial cross-sectional view of the system of FIG. 1 showing a portion of a second clip member with its clip protrusion retained in the second slot of the housing assembly and a portion of a first clip member with its clip protrusion positioned to move distally along a first slot of the housing assembly.

Referring now to FIG. 6, another elevation shows attachment system 5 with sectional views of first clip member 100, second clip member 200, and perimeter wall 18. Cap 22 is installed on distal housing end portion 24 of housing 12. Second clip member 200 is retained by housing 12 due to tip portion 228 abutting catch surface 313 of first body portion 310 and head portion 226 abutting inside surface 38 of perimeter wall 18 adjacent second slot 28. Rotating member 300 has been rotated to a second position due to second clip member 200 engaging second body member 320 as it moved distally along second slot 28. First clip member 100 is positioned to enter first slot 26. When it does so, tip portion 128 will engage second body member 320 and cause rotating member 300 to rotate in a first direction indicated by arrow 362.

Figure 7A:
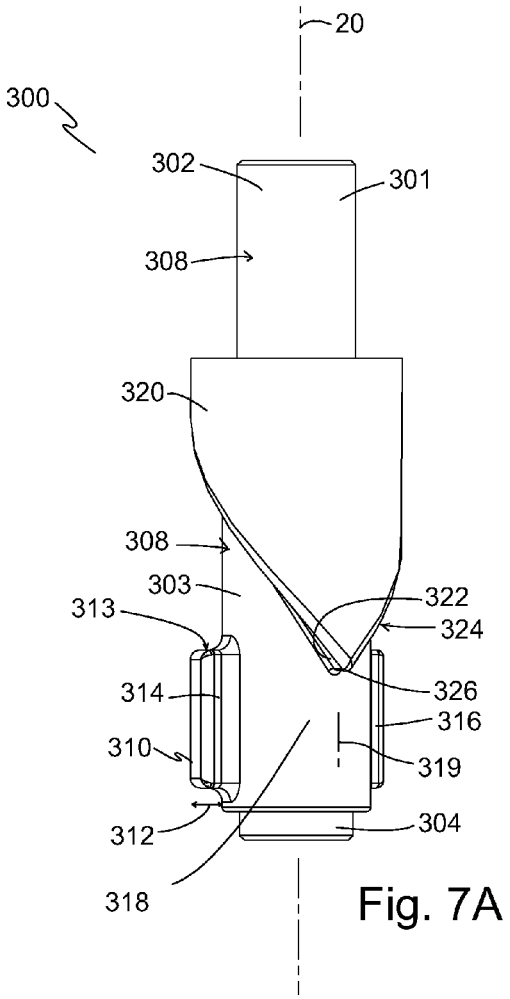
FIG. 7A is a front, side, perspective view of one embodiment of a rotating member of the present invention showing the apex of the second member body and the member channel between first and second ends of the first member body.
Figure 7C:
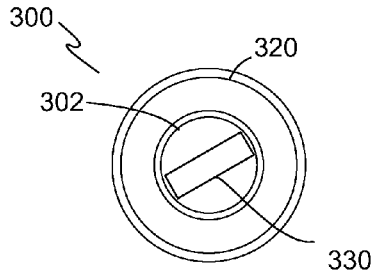
FIG. 7C is a distal end view of the rotating member of FIG. 7A showing a recess.
Figure 7B:
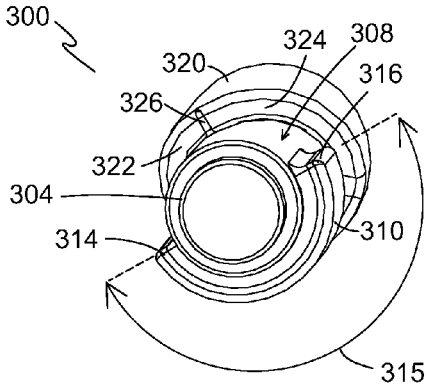
FIG. 7B is a proximal end, perspective view of the rotating member of FIG. 7A.
Figure 7D:
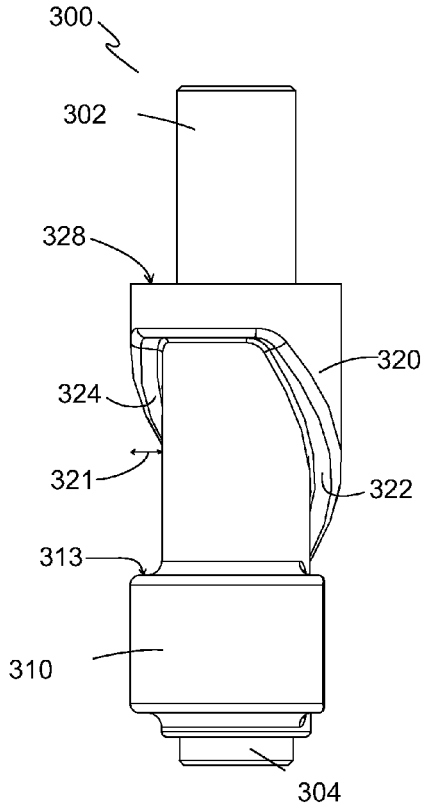
FIG. 7D is a rear perspective side view of the rotating member of FIG. 7A showing the opposite side of first member body and the second member body.

Referring now to FIGS. 7A-7D, one embodiment of rotating member 300 is illustrated. FIG. 7A is an elevation showing one side of rotating member 300, FIG. 7B illustrates a proximal end, perspective view, FIG. 7C illustrates a distal end view, and FIG. 7D is an elevation showing an opposite side of rotating member 300 than shown in FIG. 7A. Rotating member 300 has a member body 301 with a peripheral surface 308 extending parallel to central longitudinal axis 20. Member body 301 is preferably cylindrical has a distal end portion 302, a middle portion 303, and a proximal end portion 304. In one embodiment, distal end portion 302, middle portion 303, and proximal end portion 304 are cylindrical sections of different diameters. In other embodiments, member body 301 has the same diameter for each portion 302, 303, 304. In yet other embodiments, member body 301 is cylindrical with a tapering diameter from one end (e.g., distal end portion 302) to the other end (e.g., proximal end portion 304).

A first body portion 310 extends radially outward a predefined distance 312 from peripheral surface 308. First body portion 310 defines a catch surface 313 facing distally, where catch surface 313 preferably extends along a radial portion 315 of peripheral surface 308 between a first end 314 and a second end 316 of first body portion 310. In one embodiment, radial portion 315 is a substantial or major radial portion that extends along about 180° or more of peripheral surface 308. First body portion 310 defines a first body channel 318 along peripheral surface 308 between first portion end 314 and second portion end 316 of first body portion 310. Tip portions 128, 228 of clip members 100, 200, respectively, pass through channel 318 during entry and exit from housing assembly 10. Tip portions 128, 228 of clip members 100, 200, respectively, engage catch surface 313 when retained by housing assembly 10.

A second body portion 320 extends a predefined distance 321 radially outward from peripheral surface 308 and is positioned distally of first body portion 310. Second body portion 320 defines a first sloping surface 322 and a second sloping surface 324 forming an apex 326. First sloping surface 322 and second sloping surface 324 each face proximally and extend distally in opposite peripheral directions along peripheral surface 308 from apex 326. Apex 326 is aligned with channel 318. In one embodiment, apex 326 is radially aligned with a center 319 of channel 318 between first end 314 and second end 316 of first body portion 310.

As illustrated in FIG. 6C, distal end portion 302 and/or proximal end portion 304 optionally has a recess 330, such as a slot or cross, that is useful to manually rotate rotating member 300 with a screwdriver or other tool. As shown in FIG. 7D, second body member 320 preferably defines a second body shoulder 328 useful for maintaining the position of rotating member within housing 12. Shoulder 328 faces distally and is configured to abut housing 12 or cap 22 to retain the position of rotating member 300 within housing 12.

Figure 8:
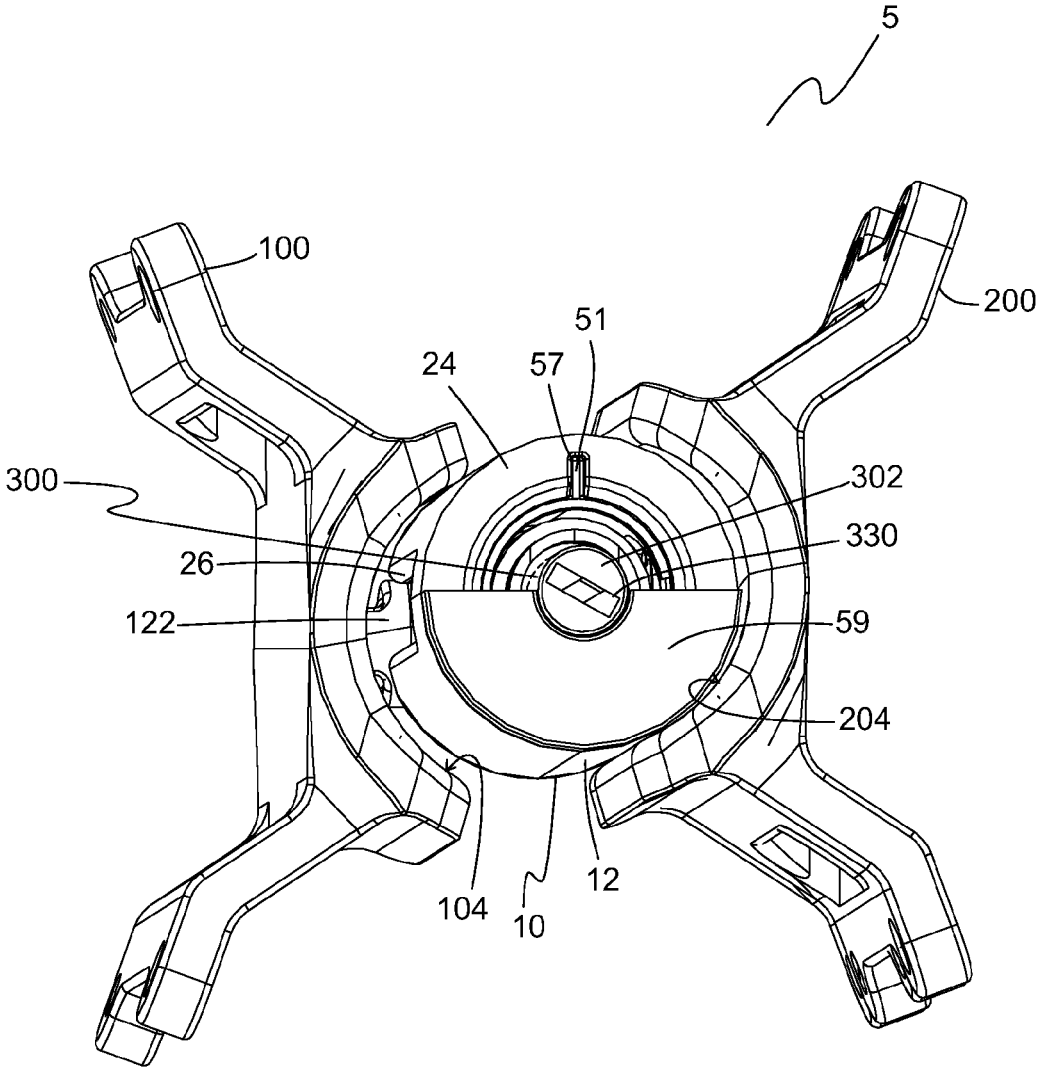
FIG. 8 is a perspective distal-end view of the attachment system of FIG. 1 showing a second clip member retained by the housing assembly, a first clip member with its clip protrusion positioned to enter the first slot of the housing assembly, and a portion of the cap.

Referring now to FIG. 8, a distal-end perspective view illustrates attachment system 5 with housing assembly 10, first clip member 100, and second clip member 200. Only a portion of cap plate 59 is visible in order to show portions of rotating member 300. Second clip member 200 is retained by housing assembly 10. First clip assembly 100 is positioned proximally of housing assembly 10. Moving first clip member 100 distally with clip protrusion 122 engaging first slot 26 results in engagement of clip protrusion 122 with rotating member 300. Recess 330 in distal end portion 302 of rotating member 300 is accessible through cap 22. The user may manually rotate rotating member 300 by using a screwdriver or other tool. Doing so may release second clip member 200 from housing assembly 10 without attaching first clip member to housing assembly 10. Centering tab 51 of cap 22 is received in tab recess 57 and maintains the rotational position of cap 22. Housing-side surfaces 104, 204 preferably have the same general shape as housing 12.

Figure 9:
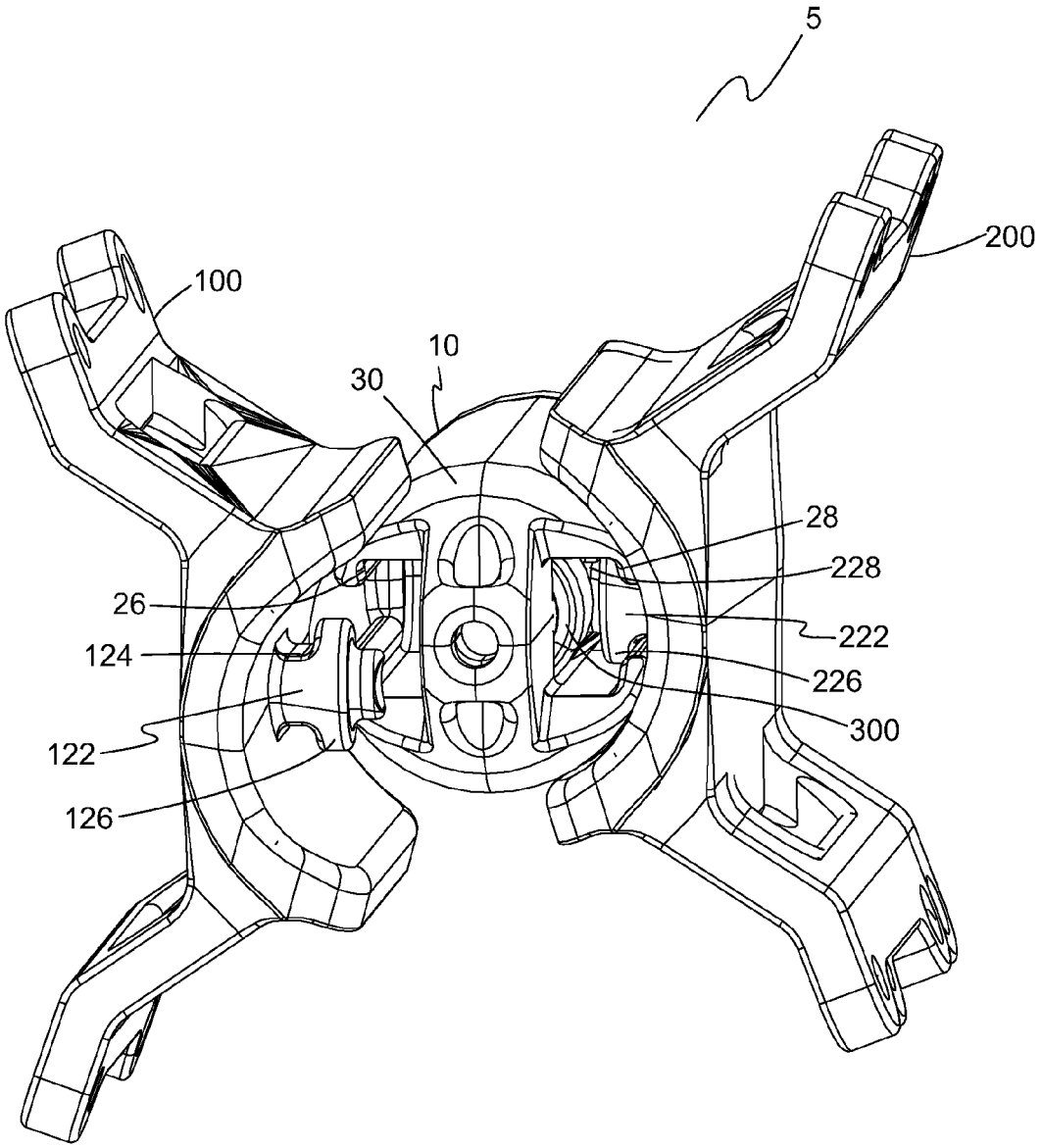
FIG. 9 is a perspective proximal-end view of the attachment system of FIG. 8.

Referring now to FIG. 9, a proximal end, perspective view illustrates attachment system 5 with housing assembly 10, first clip member 100, and second clip member 200. First clip member 100 is positioned to enter first slot 126 with neck portion 124 of clip protrusion 122 in first slot 126 and guided by head portion 124. Second clip member 200 is retained by housing assembly 10 with neck portion 224 of clip protrusion 222 in second slot 28 and tip portion 228 engaging rotating member 300.

Referring now to FIG. 10, another embodiment of attachment system 5 is shown with housing assembly 10 and first clip member 100. Housing 12 has a U-shape with first slot 26 (not visible) and second slot 28 extending along flat sides 60 of housing 12. Rotating member 300 is retained in open central region 14. In one embodiment, cap 22 (not shown) is secured to housing 12 using fasteners 62 and with cap plate 59 abutting proximal housing end portion 30. Cap 22 helps stabilize and retain rotating member 300 due to a recess or opening to receive rotating member 300 similar to cap 22 as described above. Cap plate 59 can have a variety of shapes, such as a rectangle or hour glass shape that extends across proximal housing end portion 30 and having an opening or recess to receive proximal end 304 of rotating member 300. Housing 12 has tab recess 57 to receive a centering tab 51 (not shown) on cap 22.

Figure 11:
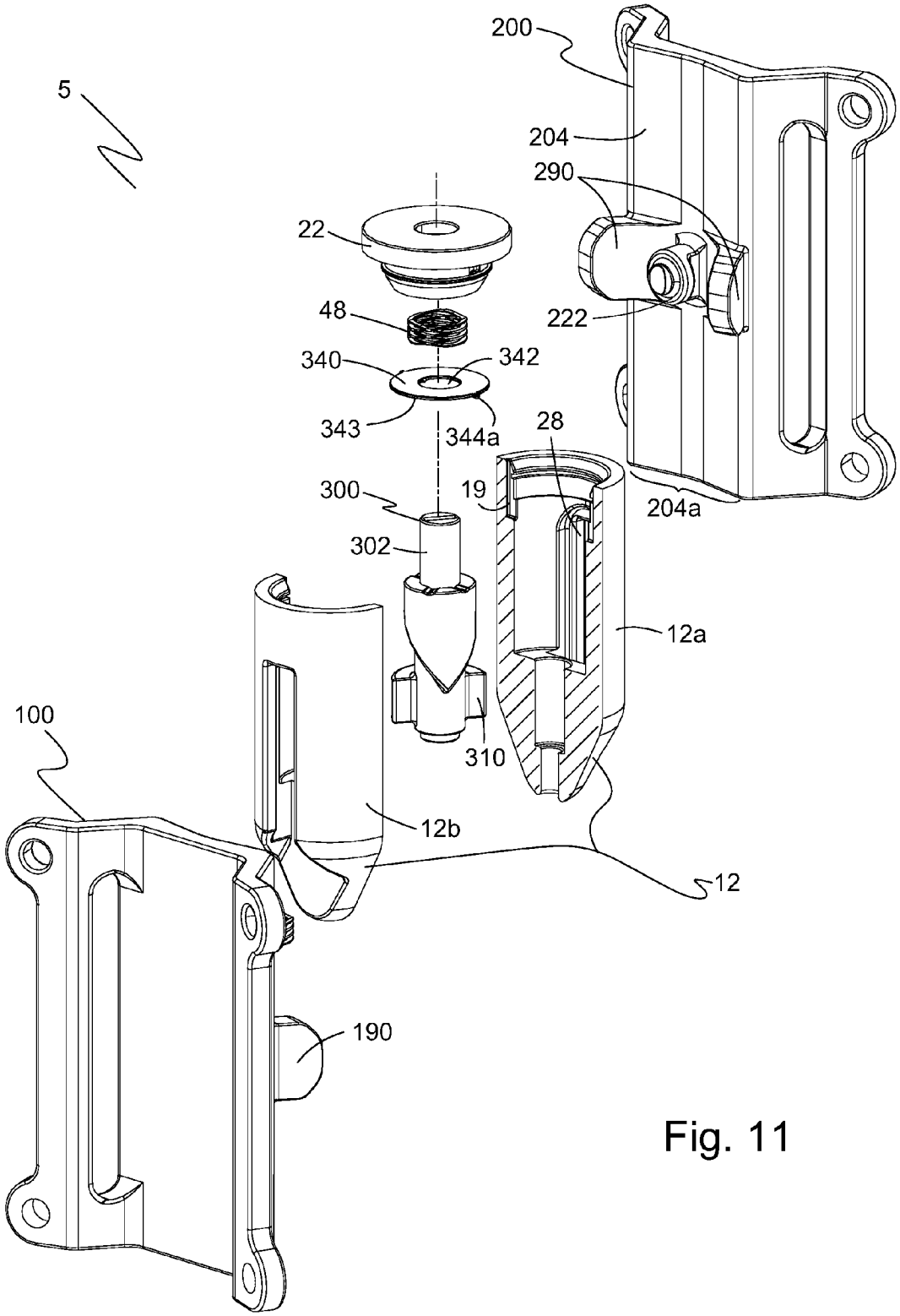
FIG. 11 is a perspective, exploded view of another embodiment of an attachment system of the present invention showing a biasing washer and a modified clip member.

Referring now to FIG. 11, a perspective, exploded view of another embodiment of attachment system 5 is illustrated. Attachment system includes housing 12 (shown as two halves 12*a*, 12*b* for clarity) with cap 22, rotating member 300, an optional biasing washer 340 adjacent biasing member 48, first clip member 100, and second clip member 200. Biasing washer 340 has a washer opening 342 sized to allow distal end portion 302 of rotating member 300 to pass therethrough and to not restrict any rotational movement of rotating member 300. Similar to the embodiment discussed above, first clip member 100 is substantially identical to second clip member 200, and therefore, only features of second clip member 200 are discussed. In this embodiment, housing-side surface 204 of second clip member 200 preferably has a slightly arcuate or substantially planar central region 204*a* that faces housing 12. A plurality of guide tabs 290 protrude from housing-side surface 204 at opposite sides of clip protrusion 222 to guide second clip member 200 as it moves along second slot 28. In one embodiment, guide tabs 290 extend at an angle of about 45° from central region 204. Guide tabs 290 may extend linearly or may be curved to substantially match the curvature of the outside surface of housing 12.

Figure 12:
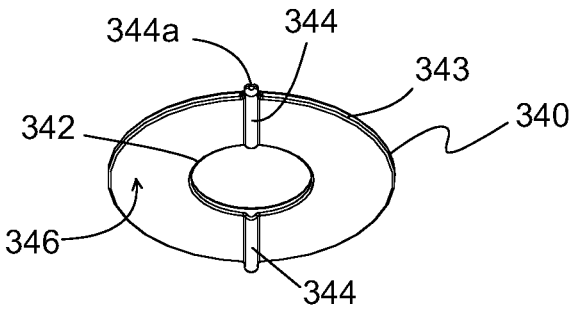
FIG. 12 illustrates a bottom perspective view of a biasing washer and a top perspective view of a rotating member of the present invention.
Figure 12:
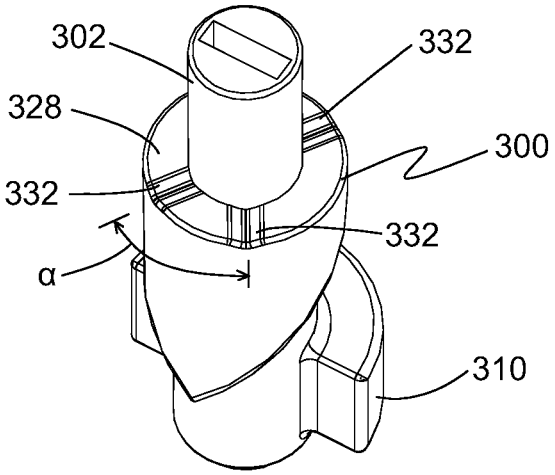

Referring now to FIG. 12, a top, perspective view of rotating member 300 and a bottom, perspective view of biasing washer 340 from FIG. 11 are shown. Biasing washer 340 has central opening 342 for being placed over distal end 302 of rotating member 300 and in abutment with second body shoulder 328 of second body portion 320. Preferably, biasing washer 340 has at least one radially extending washer rib 344 extending from a washer bottom-side surface 346. Shoulder 328 of second body portion 320 of rotating member 300 also preferably has at least one radially extending rib channel 332 defined in shoulder 328. Each rib channel 332 is shaped and positioned to at least temporarily receive a portion of corresponding washer rib 344. In this way, biasing washer 340 is seated against shoulder 328 and temporarily prevents any unrestricted rotation of rotating member 300. Washer rib 344 has a distal rib end 344*a* that extends radially beyond the major outside circumferential perimeter 343 of biasing washer 340 for engagement with a washer retaining recess 19 in housing wall 18 of housing 12. In one embodiment, each washer protrusion 344 is a rod-like structure extending radially along washer bottom-side surface 346. Other shapes are acceptable, such as rectangular or semi-spherical protrusions and pins extending perpendicularly from washer bottom-side surface 346. In one embodiment, adjacent shoulder recesses 332 extend radially and are separated by an angle $\alpha$ of about sixty degrees.

Figure 13:
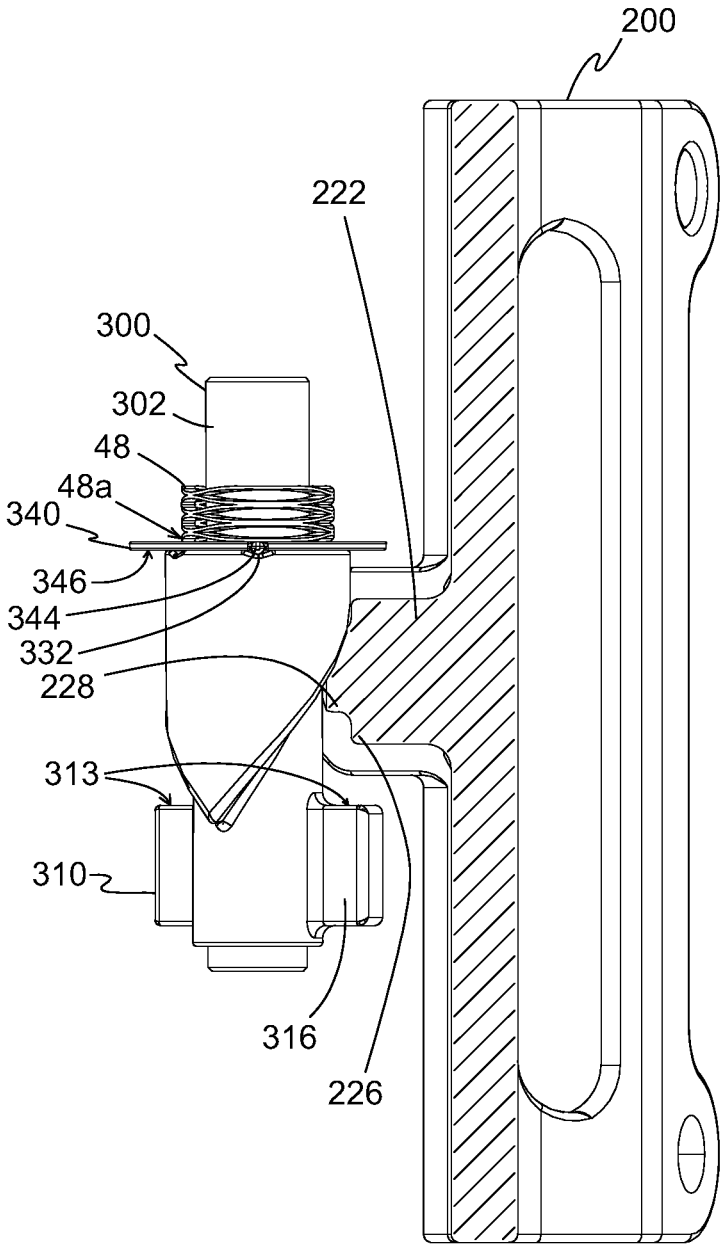
FIG. 13 is a front view of the rotating member of FIGS. 11-12 showing the biasing washer, a biasing member, and a section of a clip member.

FIG. 13 illustrates a front view of rotating member 300 with biasing washer 340, and biasing member 48. A section of second clip member 200 taken vertically through the center of clip protrusion 222 is shown as engaged with housing 12 (not shown) and rotating member 300. Washer bottom-side surface 346 abuts shoulder 328 of rotating member 300 with washer rib 344 received in a shoulder rib channel 332. Lower end 48*a* of biasing member 48 is preferably directly and fixedly connected to biasing washer 340 in order to transfer spring forces to rotating member 300, which may also be accomplished by mere frictional engagement between biasing member 48 and biasing washer 340.

As shown in FIGS. 11-13, first member body 310 has a radial diameter larger than the embodiment shown in FIGS. 7A-7D forming a larger surface area of catch surface 313. The purpose of providing a larger surface area is to engage head portion 126, 226 of clip protrusions 122, 222, respectively, instead of relying on engagement with tip portion 128, 228. In FIG. 13, tip portion 228 abuts rotating member 300 and head portion 226 is aligned to engage catch surface 313 of first member body 310 as second clip member 200 moves in engagement along rotating member 200.

Figure 14:
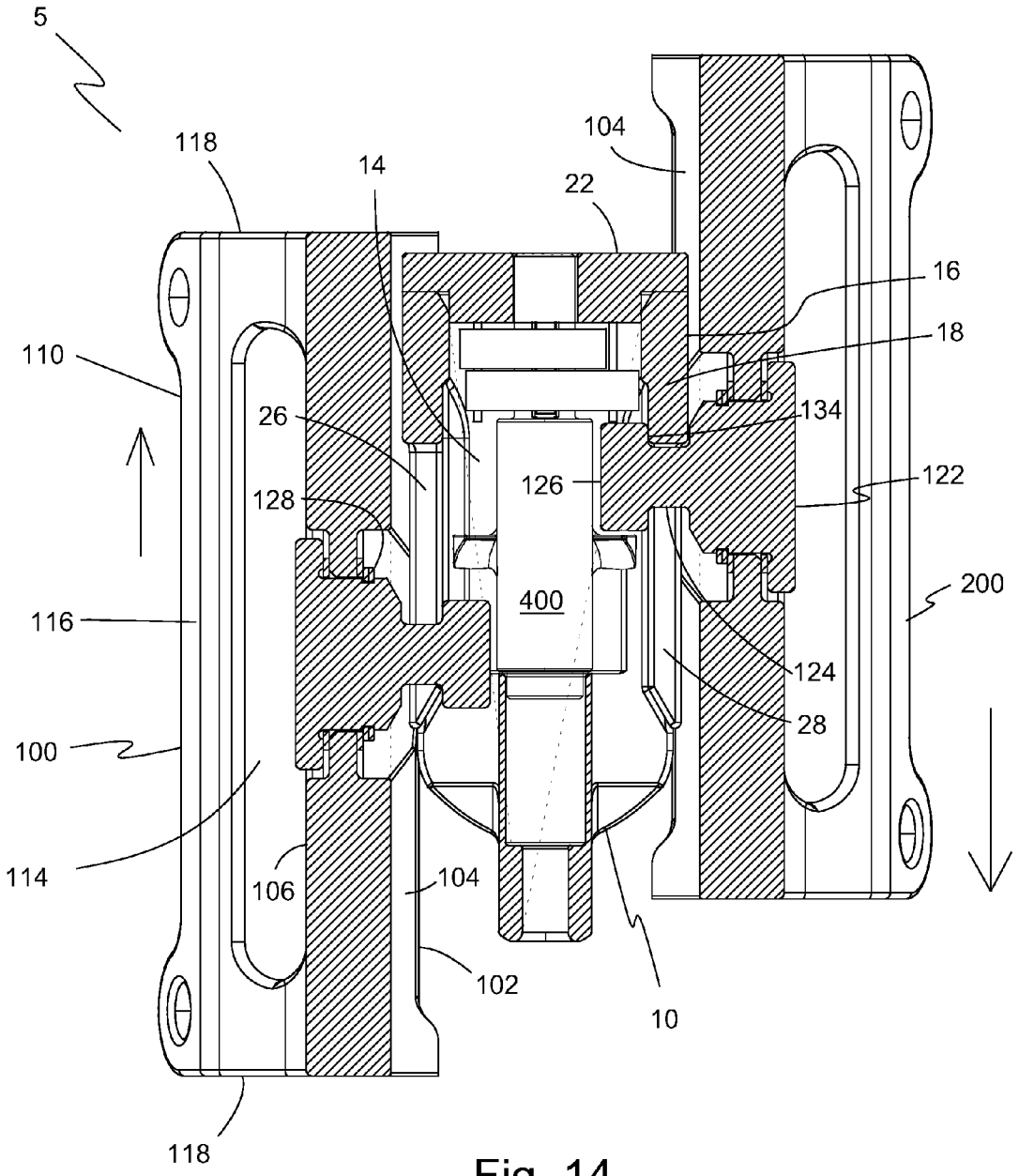
FIG. 14 is a partial cross-sectional front view of another system similar to the system of FIG. 1 showing another embodiment of a rotating member disposed in the housing, a portion of a first clip member with its clip protrusion retained in a first slot of the housing assembly and a portion of a second clip member with its clip protrusion positioned to move distally along a second slot of the housing assembly.

FIG. 14 illustrates another embodiment of an attachment system 5 that includes a housing assembly 10, a first clip member 100, and a second clip member 200. Housing assembly 10 includes a housing 12, a cap 22, and a rotating member 400 disposed in an open central region 14 within housing 12. The primary difference between this embodiment of attachment system 5 and the embodiment illustrated in FIG. 1 is the structure of the rotating member 400 and the clip members 100, 200. With respect to the clip members 100, 200, it is the structure of the clip protrusion, which does not have a tip portion.

Figure 15:
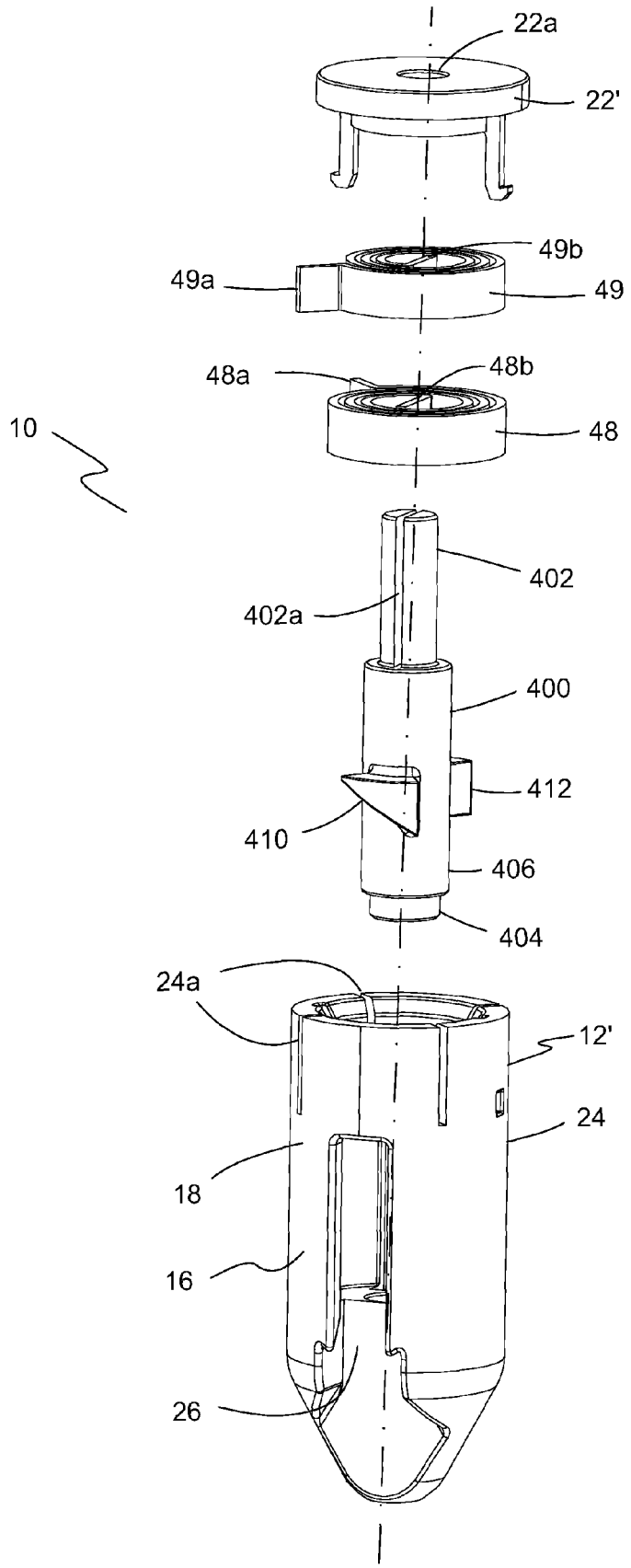
FIG. 15 is a perspective, exploded view of the embodiment of the attachment system of FIG. 14 showing a rotating member and two counter-acting springs.
Figure 16:
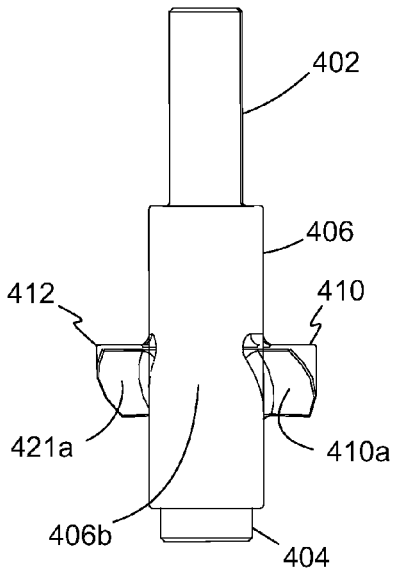
FIG. 16 is a front perspective view of the rotating member of FIG. 15 showing the front, curved surfaces of the plurality of clip member supports.
Figure 17:
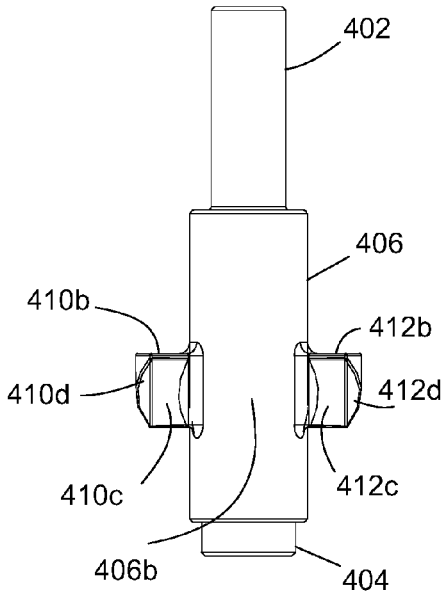
FIG. 17 is a rear perspective view of the rotating member of FIG. 15 showing the rear surfaces of the plurality of clip member supports.
Figure 18:
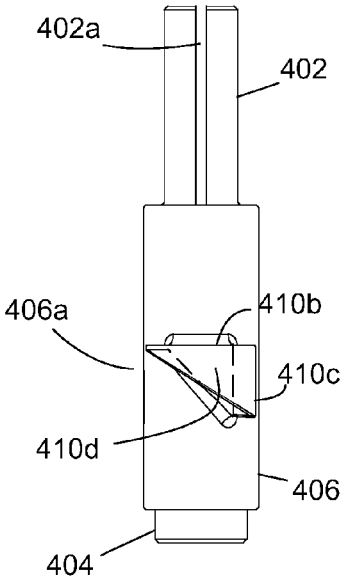
FIG. 18 is a side perspective view of the rotating member of FIG. 15 showing the side view of one of the plurality of clip member supports.
Figure 19:
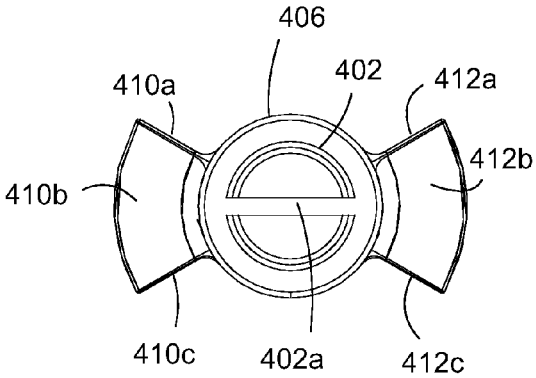
FIG. 19 is a top view of the rotating member of FIG. 15 showing the plurality of clip member support surfaces.

First clip member 100 and second clip member 200 are preferably identical and interchangeable, so the features described here for first clip member 100 also apply to embodiments of second clip member 200. First clip member 100 has a clip body 102 with a housing-side surface 104 and an outside surface 106. Housing-side surface 104 is shaped to mate with outside surface 16 of a perimeter wall 18 of housing 12. Preferably, outer surface 16 of perimeter wall 18 is substantially cylindrical. This is best seen in FIG. 15. Accordingly, housing-side surface 104 of first clip member 100 is curved with a consistent radius of curvature 108. Other geometries for housing-side surface 104 and body portion 102 are also acceptable, such as planar and curved with varying radii of curvature 108.

Figure 20:
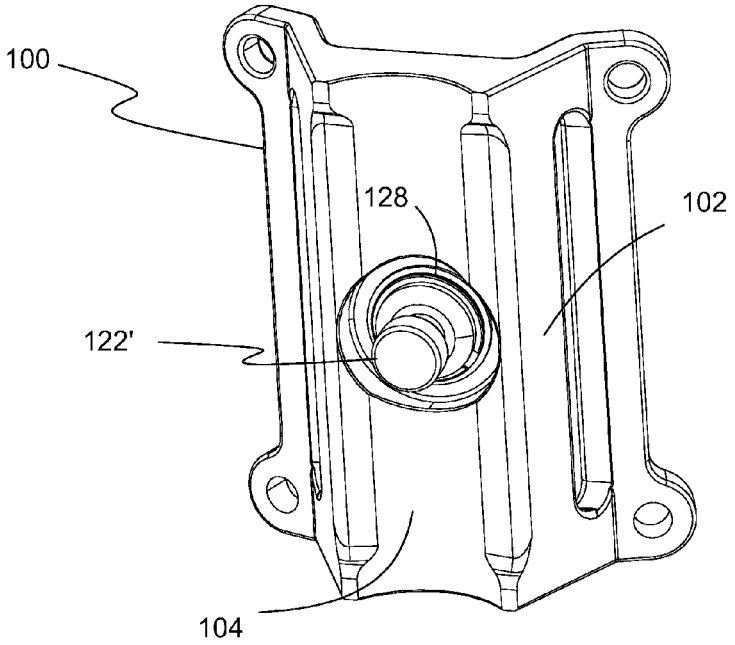
FIG. 20 is a perspective view of a clip member of FIG. 15 showing a removable clip protrusion.
Figure 21:
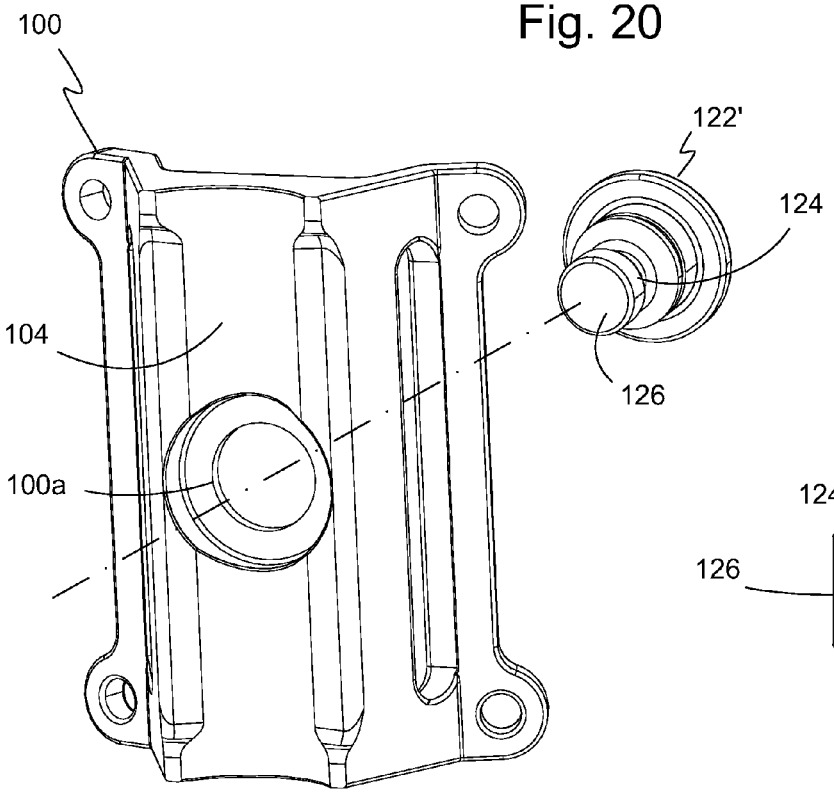
FIG. 21 is an exploded view of the clip member of FIG. 20.

As best seen in FIGS. 20 and 21, two handles 110 extend from clip body 102, preferably at an internal angle with outside surface 106 that is greater than ninety degrees. Each handle 110 defines a handle opening 114 between outside surface 106 and a longitudinal portion 116 that extends between two end portions 118 of handle 110. End portions 118 are preferably disposed at opposite ends of clip body 102. Handles 110 are useful for maneuvering first clip member 100 to engage housing assembly 10 and for attachment of clip member 100 to the user by way of a belt or webbing passing through handles 110.

A removable clip protrusion 122' extends from housing-side surface 104 and has a neck portion 124 and a head portion 126. Neck portion 124 is sized and configured to extend through first slot 26 or second slot 28 of perimeter wall 18 so that head portion 126 is disposed in open central region 14 defined within housing 12'.

As in the previously disclosed embodiment, neck portion 124 has a cross-sectional shape of a rectangle, oval, circle, or other shape. Clip protrusion 122 increases in width 130 from neck portion 124 to head portion 126. In one embodiment, head portion 126 has substantially the same length as neck portion 124. The increased size of head portion 126 relative to neck portion 124 provides a protrusion catch surface 134 that faces housing-side surface 104 of body portion 102. Protrusion catch surface 134 is shaped and configured to engage an inside surface 38 of perimeter wall 18 adjacent first slot 26 or second slot 28. In this way, clip protrusion 122 guides first clip member 100 in sliding movement along first slot 26 or second slot 28 while also retaining first clip member 100 close to or against outside surface 16 of perimeter wall 18.

Referring now to FIG. 15, a perspective, exploded view of the embodiment of housing assembly 10 of FIG. 14. Housing assembly 10 includes housing 12' with cap 22', rotating member 400, and a pair of return springs 48, 49. Cap 22' has a cap opening 22*a* sized to optionally allow distal end portion 402 of rotating member 400 to pass therethrough and to not restrict any rotational movement of rotating member 400. Each of the pair of return springs 48, 49 have an outer spring end 48*a*, 49*a* and an inner spring end 48*b*, 49*b*, respectively. Distal end portion 402 has a rotating member slot 402*a* that divides distal end portion 402 into equal halves. Rotating member slot 402*a* is configured to receive inner spring ends 48*b*, 49*b*. It is understood that rotating member slot 402*a* may be multiple slots in distal end portion 402 simply to provide an anchor point for inner spring ends 48*b*, 49*b*. Rotating member 400 has a first member wing 410 and a second member wing 412 that interact with head portion 126 of clip protrusion 122. Unlike rotating member 300 described earlier, wings 410, 412 have surfaces upon which head portion 126 interacts to turn rotating member 400 and to support heat portion 126 when head portion 126 is inserted into first or second slot 26, 28, as the case may be. As described for the previous embodiment, rotating member 400 rotates left and right depending on which slot 26, 28 is being engaged by clip members 100, 200. Return springs 48, 49 work together to return rotating member 400 to an intermediate/neutral or centered position. The intermediate/neutral or centered position places wings 410, 412 opposite first and second slots 26, 28 in housing 12'.

Housing 12' has a distal housing end portion 24 with a plurality of housing end slots 24*a* extending longitudinally into perimeter wall 18 a predefined distance sufficient to accommodate the position of return springs 48, 49 within housing 12'. Housing end slots 24*a* are configured to receive outer spring ends 48*a*, 49*a* to hold spring ends 48*a*, 49*a* in perimeter wall 18.

Turning now to FIGS. 16 to 19, there are illustrated various views of rotating member 400. To accomplish the task of simultaneously locking and releasing clip members 100, 200 within housing 12', rotating member 400 has a member body 406, distal end portion 402 that has a smaller diameter than member body 406, a proximal end portion 404 that also has a smaller diameter than member body 406, and a first and a second rotating member wings 410, 412 disposed substantially on opposite sides and extending transversely from a middle portion 406*a* of member body 406 and being a mirror-image of each other. Proximal end portion 404 is sized to seat and rotate within proximal recess 50 (shown in FIGS. 4A, 4B). Distal end portion 402 has rotating member slot 402*a* that extends, in this embodiment, the entire length of distal end portion 402. Also, in this embodiment, rotating member slot 402*a* is transverse to rotating member wings 410, 412, but may be any orientation relative to rotating member wings 410, 412 depending on the configuration of return springs 48, 49.

As can be seen from the Figures, first and second rotating member wings 410, 412 each has a curved, downwardly angled, front sloping surface 410*a*, 412*a*, respectively, a catch surface 410*b*, 412*b*, a back surface 410*c*, 412*c*, and an outer side surface 410*d*, 412*d*. On member body 406 between the front surfaces 410*a*, 412*a*, there is defined a first body channel 406*b* while between back surfaces 410*c*, 412*c*, there is defined a second body channel 406*c*. It is front surface 410*a*, 412*a* that is engaged by head portion 126 of clip protrusion 122' to rotate rotating member 400. Because rotating member wings 410, 412 are disposed within housing 12' so that wings 410, 412 align with first and second housing slots 26, 28, head portion 126 engages front surface 410*a*, 412*a*, as the case may be, as one of clip member 100 or clip member 200 enters entrance 40 of first or second slot 26, 28. Engagement of head portion 126 with one of the front surface 410*a*, 412*a* of wings 410, 412 causes rotating member 40 to rotate as the front surface slides across head portion 126 as the clip member is slid up one of slot 26, 28 of housing 12'. Rotation of member 40 causes one or both of return springs 48, 49 to tension from a relaxed state until head portion 126 moves linearly along slot 26, 28 and beyond catch surface 410*b*, 412*b*. Once head portion 126 is completely beyond catch surface 410*b*, 412*b*, rotating member 400 returns to its intermediate/neutral position due to the biasing tension caused by the respective return spring 48, 49 that was tensioned as rotating member 400 was rotated by head portion 126. Upon return of rotating member 40 to its intermediate/neutral position, catch surface 410*b*, 412*b* provides a support surface upon which head portion 126 sits and is retained within housing 12'. As head portion 126 reaches catch surface 410*b*, 412*b*, the head portion 126 of the clip member retained in the opposed slot of housing 12' that sits on the catch surface of the opposite wing is released when second body channel 406*b* aligns with head portion 126 and allowed to move out of housing 12' due to the rotation of rotating member 400. Once captured within housing 12', a clip member 100, 200 remains "locked" within housing 12' until a head portion 126 of another clip member enters the opposite slot to cause the rotating member 400 to rotate in an opposite direction to release the captured head portion of the "locked" clip member 100, 200.

Figure 21A:
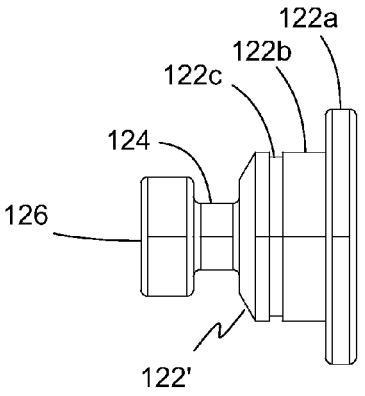
FIG. 21A is a side plan view of the removable clip protrusion of FIG. 21.

Turning now to FIGS. 20 and 21, there is illustrated another embodiment of clip member 100, 200. The main difference in this embodiment from the embodiment shown in FIGS. 2, 5 and 6 is that the clip protrusion 122' is removably attached to clip member 100, 200 instead of the clip member and clip member protrusion being an unseparable, unitary component. In this embodiment, clip member 100, 200 has a clip protrusion opening 100*a*, 200*a* for receiving clip protrusion 122'. FIG. 21A is a side plan view of clip protrusion 122'. In this embodiment, clip protrusion 122 includes an outer protrusion flange 122*a*, a protrusion body 122*b* that fits within clip protrusion opening 100*a*, 200*a*, neck portion 124 and head portion 126. As previously disclosed, neck portion 124 is sized and configured to extend through first slot 26 or second slot 28 of perimeter wall 18 so that head portion 126 is disposed in open central region 14 defined within housing 12'. Protrusion body 122*b* has a recess 122*c* for receiving a locking ring 122*d* (best shown in FIG. 14) that retains and fixes removable clip protrusion 122' to clip member 100, 200.

To use attachment system 5 of the present invention, a hand tool is tethered to housing assembly 10 using a tether extending through openings 44. First clip member 100 is secured to the user at a first location, such as a wrist, preferably with a strap (not shown). Second clip member 200 is also secured to the user at a second location, such as attached to a tool belt or to a second wrist. By choosing which clip member 100, 200 is engaged with housing assembly 10, the user may keep the tool tethered to his body without becoming tangled when switching hands on the tool or when storing the tool in a tool belt.

To switch clip members to which the hand tool is tethered, the user engages one clip member (e.g., first clip member 100) with housing assembly 10 so that it will be retained by housing assembly 10 while at the same time releasing the other clip member (e.g., second clip member 200) from housing assembly 10. To do so, the user moves first clip member 100 distally to engage housing assembly 10 with clip protrusion 122 moving along and guided by first slot 26. In the embodiment shown in FIGS. 1-13, as first clip member 100 moves distally along first slot 26, tip portion 128 of clip protrusion 122 will pass through channel 318 between first end 314 (not visible) and second end 316 of first member body 310. Tip portion 128 will proceed to engage first sloping surface 322 (not visible) of second member body 320, thereby causing rotating member 300 to rotate in first direction 362. This rotation moves first body member 310 to be in the path of tip portion 128 and prevent first clip member 100 from exiting first channel 26 in a proximal direction. Thus, a hand tool tethered to housing assembly 10 is now also attached to the user by way of first clip member 100. Retaining first clip member 100 in housing assembly 10 positions channel 318 and apex 326 so that second clip member 200 (not shown) may exit through second channel 52*b* if located there, or so that clip protrusion 222 (not shown) of second clip member 200 may enter second channel 52*b*. Thus, a user of attachment system 5 may use clip members 100, 200 to switch hands on a tool tethered to housing assembly 10. Similarly, the user may selectively tether a tool to any one of several clip members located on the user's wrist, tool belt, or other location. For the embodiment illustrated in FIGS. 14-21, the behavior of rotating member 400 relative to the head portion of clip protrusion 122' was previously described.

When beginning to use a tool, for example, the user engages first clip member 100 with housing assembly 10, where first clip member 100 is secured to the user's wrist. The tool is now tethered to the user's wrist. After completing a task, the tool is stored in a pouch on the tool belt. The user then engages housing assembly 10 with second clip member 200 located on the user's tool belt. First clip member 100 is thereby released from housing assembly 10 and the tool is now tethered to the user's tool belt.

Although the preferred embodiments of the present invention have been described herein, the above description is merely illustrative. Further modification of the invention herein disclosed will occur to those skilled in the respective arts and all such modifications are deemed to be within the scope of the invention as defined by the appended claims.

What is claimed is:

1. An attachment system for hand-held tools comprising:

a housing with a proximal housing end portion, a distal housing end portion, and a peripheral wall defining an open central region within the housing, the peripheral wall having a first slot and a second slot spaced from the first slot, each with a predefined slot width and extending through the peripheral wall to the open central region, wherein the first slot and the second slot each has a proximal slot end and a distal slot end, the proximal slot end having a proximal slot end width that is greater than the predefined slot width;

a rotating member disposed in the open central region and configured to rotate about the central longitudinal axis between a first position and a second position, the rotating member having a sloping surface and a catch surface where both extend transversely from the rotating member and wherein the sloping surface is aligned with one of the first slot and the second slot;

a clip member having a clip body with a housing-side surface and a clip protrusion having a neck portion and a head portion wherein the clip protrusion extends transversely away from the housing-side surface, the clip protrusion adapted to be slidably received in and retained by one of the first slot and the second slot wherein the clip protrusion engages the sloping surface of the rotating member to move the rotating member to either the first position or the second position and to either retain the clip protrusion within or to release the clip protrusion from the housing;

wherein the clip protrusion moving distally in the first slot a sufficient distance causes the rotating member to rotate in a first direction about the central longitudinal axis and causes the catch surface to rotate beneath the clip protrusion to retain the first clip member in engagement with the housing assembly.

2. The attachment system according to claim 1 further comprising a first biasing member disposed between the housing and the rotating member, the first biasing member configured to rotationally bias the rotating member towards an intermediate position between the first position and the second position, whereby the catch surface of the first body portion is positioned to engage the tip portion of the clip member to retain the clip member within the housing.

3. The attachment system according to claim 2 wherein the first biasing member is a spring connected between the rotating member and the housing.

4. The attachment system according to claim 2 wherein the rotating member comprising:

a member body rotatably connected to the housing;

a distal end portion connected to one end of the member body;

a proximal end portion connected to an opposite end of the member body; and a first member wing and a second member wing disposed on opposite sides of and extending transversely from a middle portion of the member body, each of the first member wing and the second member wing having a curved, front sloping surface, a catch surface and a back surface and defining a first body channel between the front sloping surface of the first member wing and the second member wing and a second body channel between the back surface of the first member wing and the second member wing.

5. The attachment system according to claim 4 wherein the clip member has a clip body with a housing-side surface and a clip protrusion extending from the housing-side surface and having a head portion and a neck portion, the neck portion sized to be slidably received in one of the first slot and the second slot, the head portion sized and configured to engage the first sloping surface or the second sloping surface and to rotate the rotating member about the central longitudinal axis as the neck portion moves along one of the first slot and second slot from the proximal slot end; and wherein the head portion moving distally in the first slot in engagement with the first sloping surface, causes the rotating member to rotate from an intermediate position in a first direction about the central longitudinal axis, thereby causing the first body channel to align with the head portion of the clip member allowing the head portion to pass above the first member wing, and thereby causing the second body channel to align with a head portion of a clip member retained in the second slot of the housing allowing the head portion to pass below the second member wing whereby the rotating member returns to the intermediate position after each head portion passes through the respective first body channel and the second body channel.

6. The attachment system according to claim 4, further comprising a second biasing member disposed between the housing and the rotating member, the first biasing member and the second biasing member configured to rotationally bias the rotating member towards the intermediate position between the first position and the second position.

7. The attachment system according to claim 4, wherein the first biasing member and the second biasing member is a spring connected between the rotating member and the housing.

8. The attachment system according to claim 1 wherein the head portion is sized and configured to engage an inside surface of the housing when the neck portion extends through the first slot or the second slot.

9. The attachment system according to claim 1 wherein the peripheral wall is substantially cylindrical.

10. The attachment system according to claim 1 further comprising a cap installed on the housing distal end portion, the cap having a recess sized and configured to receive a distal end of the rotating member.

11. The attachment system according to claim 10 wherein the cap defines an opening configured to permit access to the distal end of the rotating member.

12. The attachment system according to claim 11 wherein the distal end of the rotating member is configured for engagement with a tool for rotating the rotating member.

13. The attachment system according to claim 1, wherein the rotating member is maintained at one of the first position or the second position until a second clip member engages the rotating member to rotate the rotating member to the other of the first position or the second position.

14. A method of tethering a hand tool comprising:

tethering a tool to a housing assembly comprising:

a housing with a proximal housing end portion, a distal housing end portion, and a peripheral wall defining an open central region within the housing, the peripheral wall having a first slot and a second slot each with a predefined slot width and extending through the peripheral wall to the open central region, wherein the first slot and the second slot each has a proximal slot end and a distal slot end, the proximal slot end having a proximal slot end width that is greater than the predefined slot width;

a rotating member disposed in the open central region and configured to rotate about the central longitudinal axis between an intermediate position, a first position and a second position, the rotating member having a sloping surface and a catch surface;

engaging a first clip member with the housing assembly, the clip member having a clip body with a housing-side surface and a clip protrusion extending from the housing-side surface, the clip protrusion adapted to be slidably received in and retained by one of the first slot and the second slot wherein the clip protrusion engages the rotating member to move the rotating member to either the first position or the second position and either retain the clip protrusion or to release the clip protrusion from the housing; and moving the clip protrusion distally in the first slot a sufficient distance to cause the rotating member to rotate in a first direction about the central longitudinal axis allowing the clip protrusion to move along the rotary member beyond the catch surface and cause the catch surface to rotate beneath the clip protrusion to retain the first clip member in engagement with the housing assembly.

15. The method according to claim 14 further comprising slidably removing a second clip member from the second slot of the housing when the rotatable member is rotated to cause the catch surface to retain the first member clip in engagement with the housing assembly.

16. The method according to claim 14 further comprising:

engaging a second clip member with the housing assembly, the second clip member having a second clip protrusion substantially identical to the clip protrusion of the first clip member, moving the second clip member distally along the second slot a sufficient distance with the second clip protrusion in engagement with rotating member, thereby causing the rotating member to rotate in a second direction about the central longitudinal axis allowing the clip protrusion to move along the rotatable member beyond the catch surface and cause the catch surface to rotate beneath the clip protrusion and to retain the second clip member while simultaneously causing the catch surface to release the first clip member; and moving the first clip member proximally in the first slot to release the first clip member from engagement with the housing assembly; and removing the first clip member from the housing assembly.

17. The method according to claim 14 wherein the step of tethering a tool to a housing assembly includes selecting a housing assembly with a rotating member comprising:

a member body rotatably connected to the housing;

a distal end portion connected to one end of the member body;

a proximal end portion connected to an opposite end of the member body; and a first member wing and a second member wing disposed on opposite sides of and extending transversely from a middle portion of the member body, each of the first member wing and the second member wing having a curved, front sloping surface, a catch surface and a back surface and defining a first body channel between the front sloping surface of the first member wing and the second member wing and a second body channel between the back surface of the first member wing and the second member wing.

18. The method according to claim 14 further comprising attaching one of the first clip member or the second clip member to a user's wrist.

19. The method according to claim 14 further comprising attaching the other of the first clip member or the second clip member to a user's tool belt.

* * * * *